US010173797B2

(12) United States Patent
Rea et al.

(10) Patent No.: US 10,173,797 B2
(45) Date of Patent: Jan. 8, 2019

(54) UNIT FOR FILLING CONTAINING ELEMENTS OF SINGLE-USE CAPSULES FOR EXTRACTION OR INFUSION BEVERAGES

(71) Applicant: GIMA S.P.A., Zola Presdosa (BO) (IT)

(72) Inventors: Dario Rea, Monterenzio (IT); Emanuele Rubbi, Castel Guelfo di Bologna (IT); Pierluigi Castellari, Castel San Pietro Terme (IT)

(73) Assignee: GIMA S.P.A., Zola Predosa (IT)

( * ) Notice: Subject to any disclaimer, the term of this patent is extended or adjusted under 35 U.S.C. 154(b) by 424 days.

(21) Appl. No.: 15/029,500

(22) PCT Filed: Oct. 3, 2014

(86) PCT No.: PCT/IB2014/065041

§ 371 (c)(1),
(2) Date: Apr. 14, 2016

(87) PCT Pub. No.: WO2015/056127

PCT Pub. Date: Apr. 23, 2015

(65) Prior Publication Data

US 2016/0229570 A1 Aug. 11, 2016

(30) Foreign Application Priority Data

Oct. 18, 2013 (IT) ..... BO2013A0577

(51) Int. Cl.
*B65B 1/10* (2006.01)
*B65B 1/12* (2006.01)
(Continued)

(52) U.S. Cl.
CPC ..... *B65B 29/02* (2013.01); *B65B 1/10* (2013.01); *B65B 1/12* (2013.01); *B65B 1/30* (2013.01);
(Continued)

(58) Field of Classification Search
CPC .... B65B 1/10; B65B 1/12; B65B 1/24; B65B 1/30; B65B 1/363; B65B 1/385;
(Continued)

(56) References Cited

U.S. PATENT DOCUMENTS 2,196,403 A * 4/1940 Thompson ..... B65B 39/145 141/101
2,340,637 A * 2/1944 Bauer ..... B65B 1/30 141/103
(Continued)

FOREIGN PATENT DOCUMENTS

CH 558 739 A 2/1975
DE 29 44 494 A1 5/1981
(Continued)

*Primary Examiner* — Stephen F. Gerrity
(74) *Attorney, Agent, or Firm* — Pearne & Gordon LLP

(57) ABSTRACT

Described is a unit for filling containing elements (2) of single-use capsules (3) for extraction or infusion beverages, comprising: a line (4) for transport of containing elements (2) designed to contain a dose (33) of product; a station (SR) for filling the containing elements (2) comprising: at least a first containing seat (S1) designed to receive a dose (33); a substation (ST1) for forming a dose (33) inside the first containing seat (S1); at least a second containing seat (S2) designed to receive the dose (33) from the first containing seat (S1); a substation (ST2) for transferring the dose (33) from the first containing seat (S1) to the second containing seat (S2); devices (7) for moving the first containing seat (S1) between the forming substation (ST1) and the transfer substation (ST2) and vice versa; a substation (ST3) for releasing the dose (33) from the second containing seat (S2) to a containing element (2); further devices (8) for moving the second containing seat (S2) between the transfer substation (ST2) and the release substation (ST3) and vice versa.

17 Claims, 11 Drawing Sheets

(51) Int. Cl.
*B65B 1/30* (2006.01)
*B65B 1/38* (2006.01)
*B65B 7/28* (2006.01)
*B65B 29/02* (2006.01)

(52) U.S. Cl.
CPC ..... *B65B 1/385* (2013.01); *B65B 7/28* (2013.01); *B65B 29/022* (2017.08)

(58) Field of Classification Search
CPC ..... B65B 7/28; B65B 29/02; B65B 29/022; B65B 37/10; B65B 37/20; B65B 39/145; B65B 63/022
USPC ..... 53/438, 471, 529, 282
See application file for complete search history.

(56) References Cited

U.S. PATENT DOCUMENTS 2,567,052 A * 9/1951 Carruthers ..... B65B 63/022 100/178
2,644,629 A * 7/1953 Velie ..... B65B 1/24 141/146
2,689,676 A * 9/1954 Ferguson et al. ..... B65B 1/363 141/101
3,026,660 A * 3/1962 Luthi et al. ..... B65B 1/363 53/529
3,168,121 A * 2/1965 Barthelemy ..... B65B 1/385 141/141
3,179,041 A * 4/1965 Luthi et al. ..... B65B 39/145 100/223
3,213,587 A * 10/1965 Carruthers ..... B65B 1/363 53/435
3,213,901 A * 10/1965 Luthi et al. ..... B65B 63/022 141/12
3,552,454 A * 1/1971 Deming, Sr. ..... B65B 1/24 100/223
4,107,977 A * 8/1978 Grinberg et al. ..... G01M 3/02 73/45.3
4,326,568 A * 4/1982 Burton et al. ..... B65B 39/145 141/114
5,791,127 A 8/1998 Rossi
5,855,233 A * 1/1999 Bolelli ..... A61J 3/074 141/103
6,425,422 B1 * 7/2002 Trebbi ..... B65B 1/363 141/12
7,610,735 B2 * 11/2009 Monti ..... B65B 5/103 53/244
2013/0318913 A1 * 12/2013 Monti ..... B65B 39/145 53/147
2014/0202120 A1 7/2014 Scrivani

FOREIGN PATENT DOCUMENTS

GB 672945 A * 5/1952 ..... B65B 1/385
WO 2010/007633 A1 1/2010
WO 2013/035061 A2 3/2013

* cited by examiner

UNIT FOR FILLING CONTAINING ELEMENTS OF SINGLE-USE CAPSULES FOR EXTRACTION OR INFUSION BEVERAGES

TECHNICAL FIELD

This invention relates to a unit and a method for filling containing elements of single-use capsules for extraction or infusion beverages with a dose of product.

BACKGROUND ART

The prior art capsules, used in machines for making extraction or infusion beverages, comprise in their simplest form, the following:

- a rigid, cup-shaped outer container comprising a perforatable or perforated bottom and an upper aperture provided with a rim (and usually, but not necessarily, having the shape of a truncated cone);
- a dose of product for extract or infusion beverages contained in the outer container;
- and a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, the capsules may comprise one or more rigid or flexible filtering elements.

For example, a first filter (if present) may be located on the bottom of the rigid container.

A second filter (if present) may be interposed between the piece of sealing sheet and the product dose.

The dose of product may be in direct contact with the rigid, cup-shaped outer container, or with a filtering element.

The capsule made up in this way is received and used in specific slots in machines for making beverages.

In the technical sector in question, the need is particularly felt for filling in a simple and effective way the rigid, cup-shaped containers or the filtering elements whilst at the same time maintaining a high productivity.

It should be noted that, in this regard, there are prior art packaging machines having a filling unit which allows the simultaneous filling of several parallel rows of rigid, cup-shaped containers, which are advancing.

In this case, each row of rigid, cup-shaped containers is associated with a dedicated filling device, generally equipped with a screw feeder to allow the descent of the product inside the container.

This type of unit is therefore obviously quite expensive and complex, since it comprises a plurality of devices and drives (one for each screw device) which are independent from each other and which must necessarily be coordinated.

Moreover, the overall reliability of the machine resulting from this configuration/arrangement of elements is necessarily limited because the rate of faults is inevitably linked with the number of devices and drives present.

Moreover, the screw feeder devices may have drawbacks due to clogging, soiling and poor dosing accuracy. More in detail, the end part of the screw feeder is not normally able to retain the product, which therefore falls and soils the machine.

A strongly felt need by operators in this sector is that of having a unit and a method for filling containing elements (rigid, cup-shaped containers) of single-use capsules for extraction or infusion beverages which are particularly simple, reliable and inexpensive and at the same time maintain a high overall productivity.

DISCLOSURE OF THE INVENTION

The aim of this invention is therefore to satisfy the above-mentioned need by providing a unit and a method for filling containing elements (rigid, cup-shaped containers) of single-use capsules for extraction or infusion beverages which can be made relatively simply and inexpensively and which is particularly reliable.

Another aim of the invention is to provide a machine for packaging single-use capsules for extraction or infusion beverages which can guarantee a high productivity.

BRIEF DESCRIPTION OF THE DRAWINGS

The technical features of the invention, with reference to the above aims, are clearly described in the claims below and its advantages are apparent from the detailed description which follows, with reference to the accompanying drawings which illustrate a non-limiting example embodiment of the invention and in which:

DETAILED DESCRIPTION OF PREFERRED EMBODIMENTS OF THE INVENTION

With reference to the accompanying drawings, the numeral 1 denotes a unit for filling containing elements of single-use capsules 3 for extraction or infusion beverages, with a dose 33 of solid product in powder, granules or leaves, such as coffee, tea, milk, chocolate, or combinations of these.

The filling unit 1 is particularly suitable for filling containing elements of single-use capsules 3 with products in powder, preferably coffee.

Figure 2:
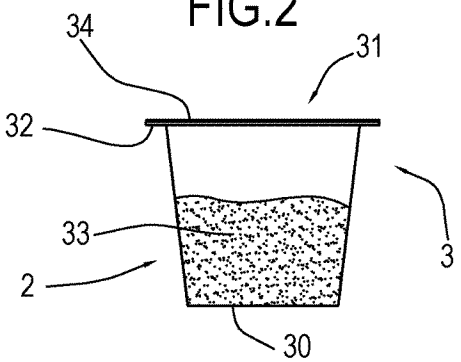
FIG. 2 is a schematic view of a single-use capsule for beverages which can be made by the machine of FIG. 1.
Figure 3:
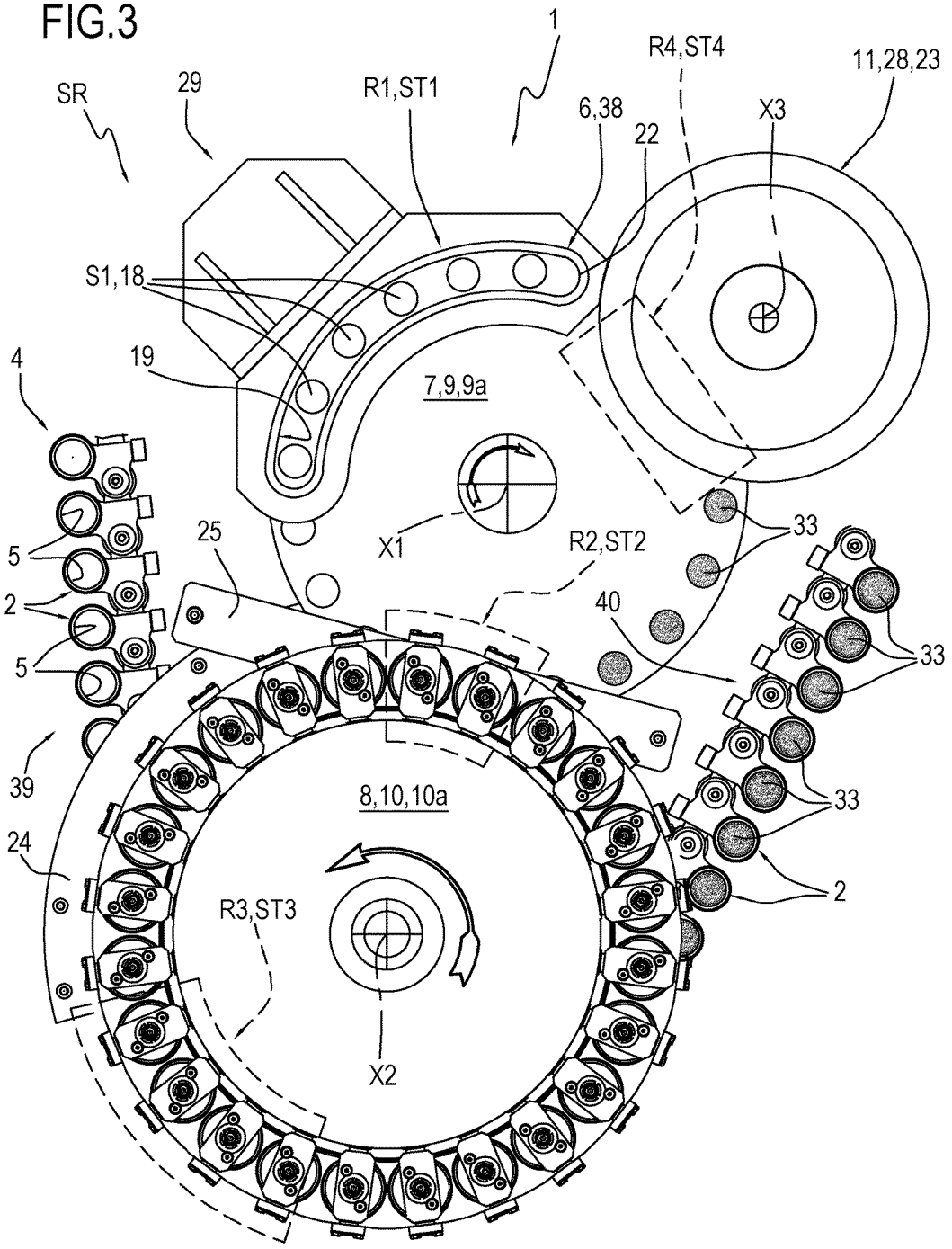
FIGS. 3 and 4 show corresponding plan views of the unit for filling a single-use capsule of FIG. 1.
Figure 4:
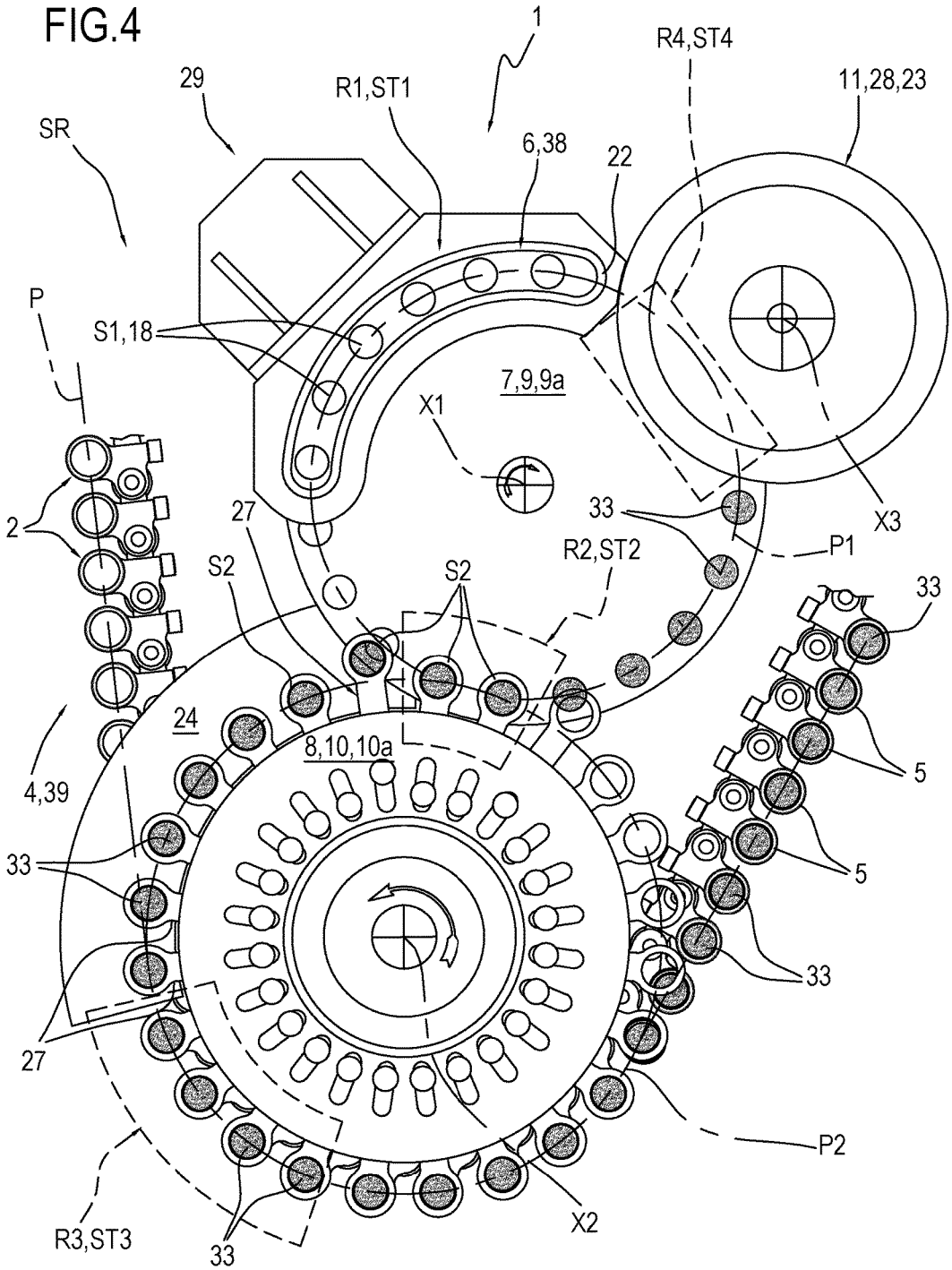
Figure 5:
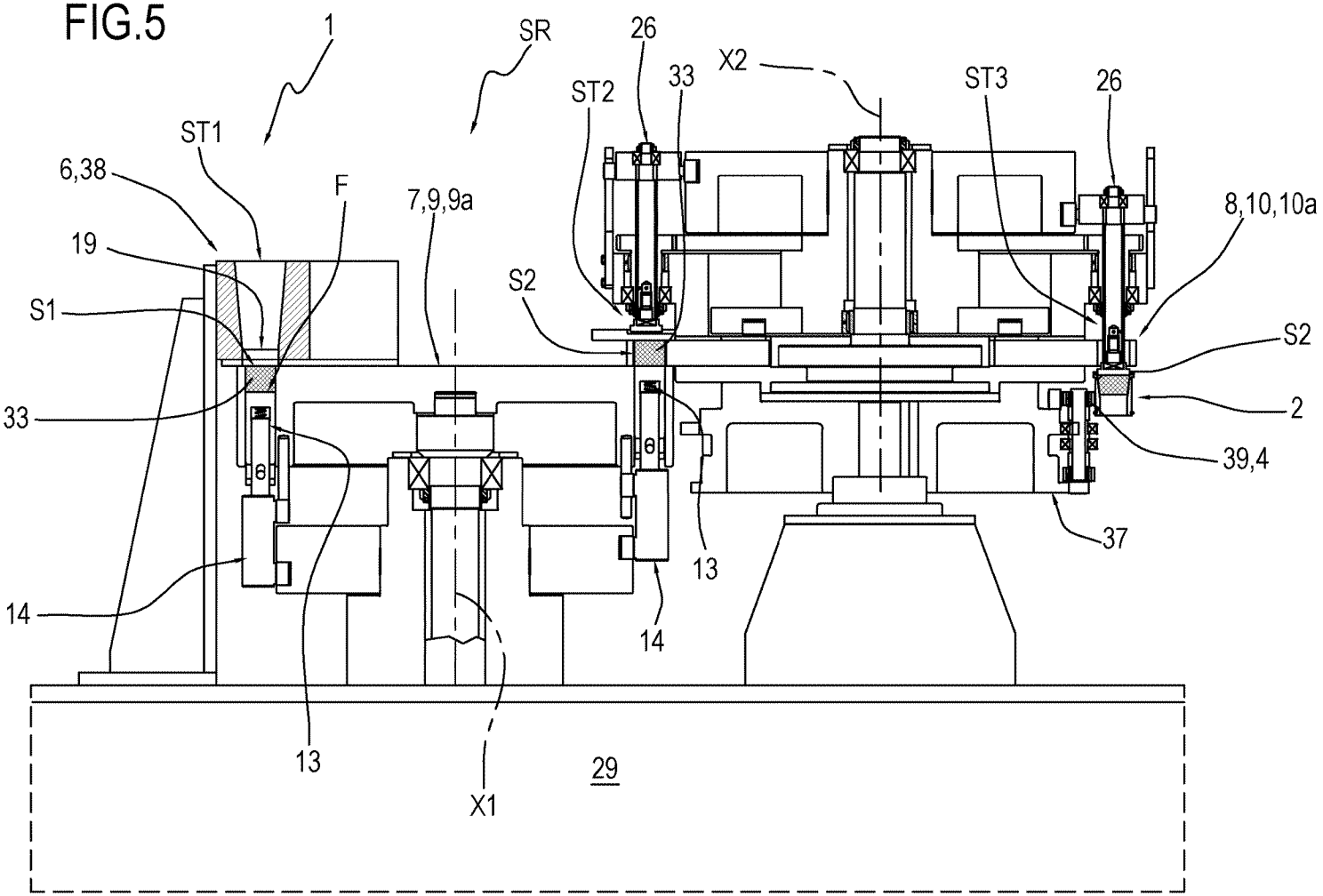
FIG. 5 is a cross section view of a filling station of a filling unit of FIGS. 3 and 4, with some parts cut away to better illustrate others.
Figure 6:
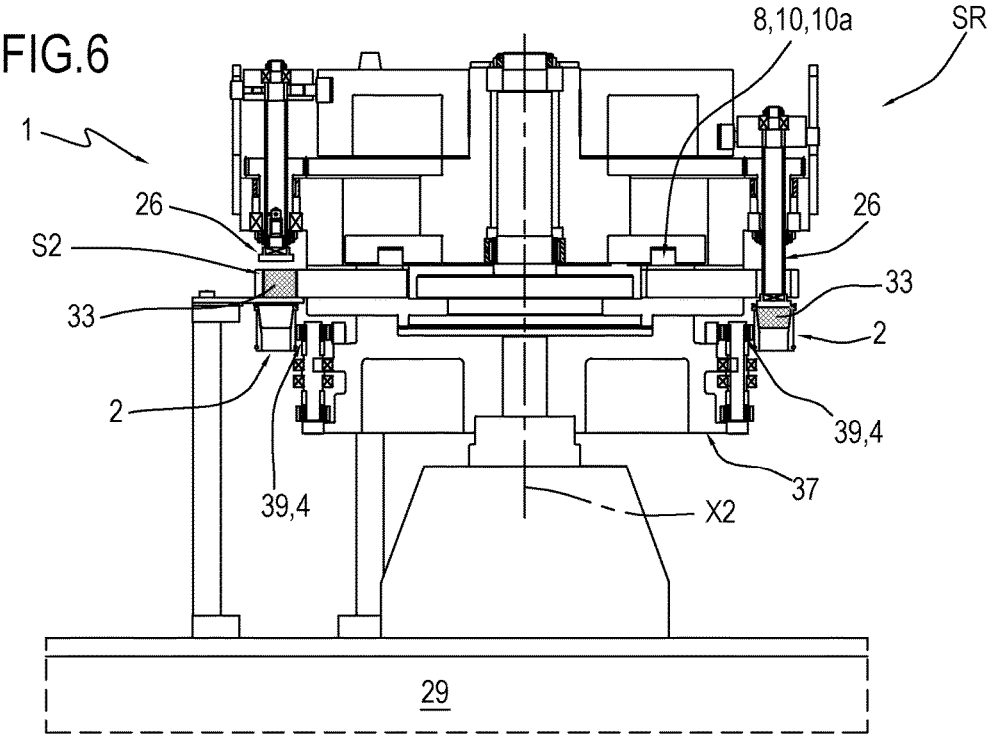
FIGS. 6 and 7 are respective cross sections of components of the filling station of FIG. 5, with some parts cut away to better illustrate others.
Figure 7:
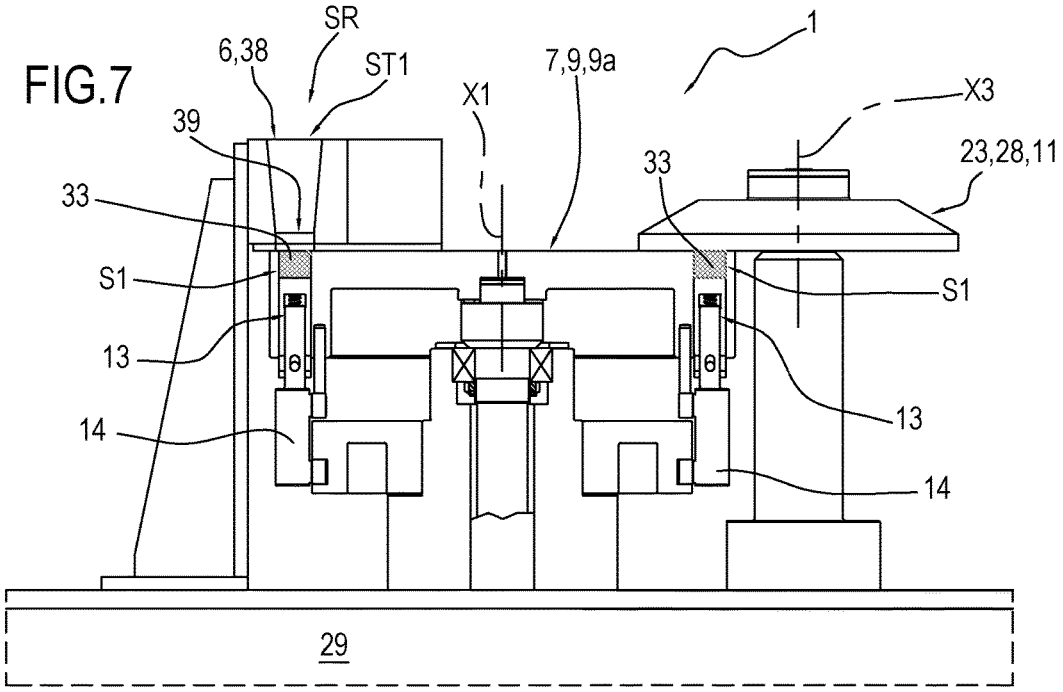
Figure 8:
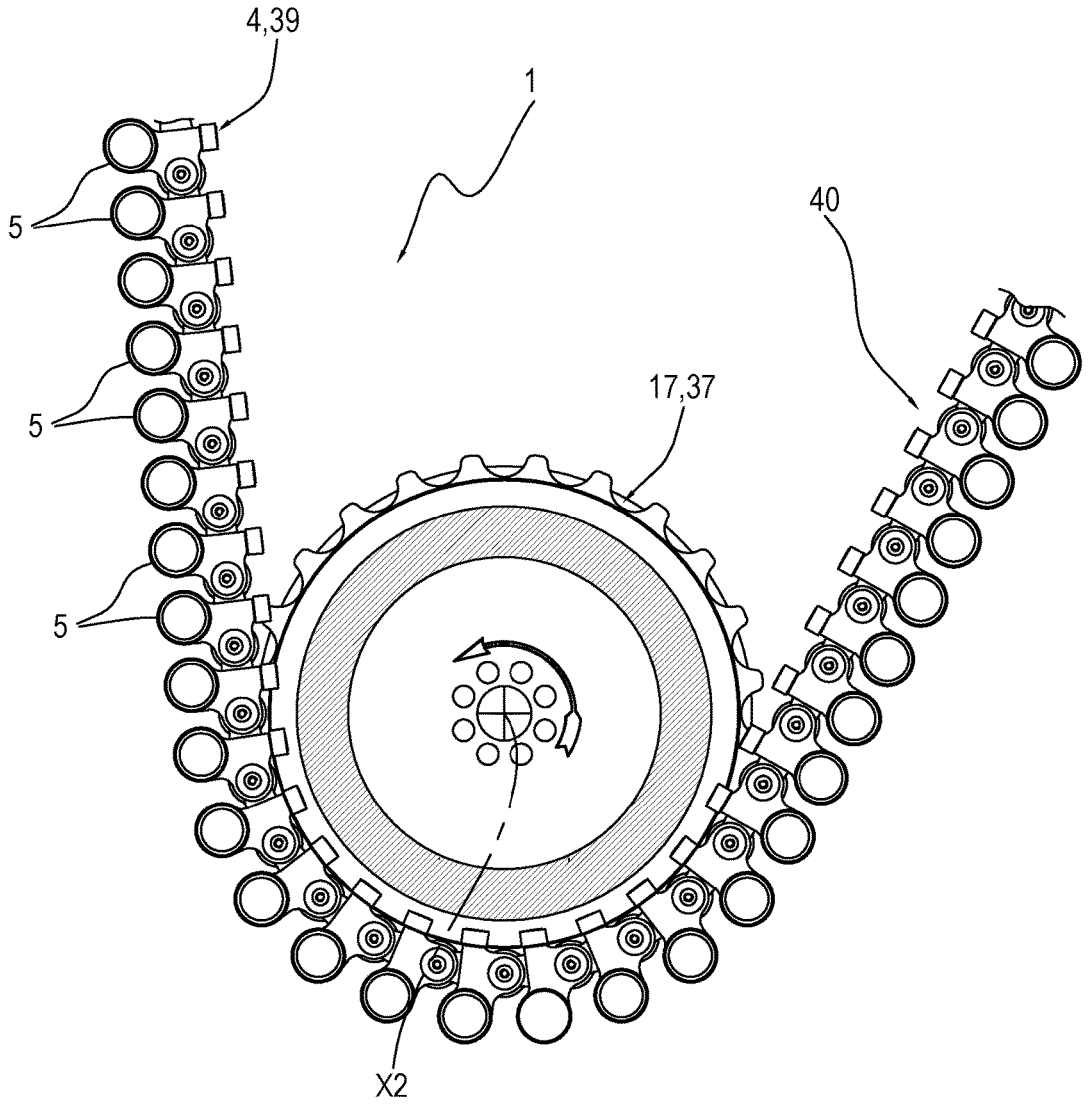
FIG. 8 is a plan view of a detail of the filling unit of FIG. 1.

More specifically, as illustrated in FIG. 2, the single-use capsules 3 for extraction or infusion beverages comprise, in a minimum, but non-limiting, embodiment: a rigid, cup-shaped container 2 (usually to define a frustoconical shape) comprising a base 30 and an upper opening 31 equipped with a collar 32; a dose 33 of extraction or infusion product contained in the rigid container 2 and a lid 34 for closing the upper opening 31 of the rigid container 2.

It should also be noted that this type of capsule 3 may also comprise one or more filtering or product retaining elements (not illustrated here for simplicity reasons).

In the capsule 3 illustrated in FIG. 2, the rigid, cup-shaped container 2 defines the containing element to be filled with a dose 33 of product.

Other types of capsules may be filled with the filling unit according to the invention, for example capsules wherein the dose 33 of product is contained in, and retained by, a filtering element connected to the rigid container, wherein the rigid container can be closed at the bottom, or open.

In other words, in capsules not illustrated, a filtering element may contain and retain the dose 33 of product, forming the containing element in combination with the rigid container with which it is coupled.

In the following description, reference will be made to the rigid, cup-shaped container 2, but it is understood that the invention can be made with reference to capsules wherein the containing element is formed by a filtering element (or other components of the capsule designed to contain a dose 33 of product) and by the respective rigid container to which it is connected.

It should be noted that the filling unit 1 comprises a line 4 for transport (that is to say, movement) of rigid, cup-shaped containers 2 designed to contain a predetermined quantity of extraction or infusion product (dose 33) and a filling station SR.

The transport line 4 extends along a first movement path P and is provided with a plurality of seats 5 for supporting the rigid containers 2, arranged in succession along the first path P.

Preferably, the first movement path P is a closed path lying on a horizontal plane.

The supporting seats 5 are arranged one after another, not necessarily continuously, along the first path P.

In addition, the supporting seats 5 each have a corresponding vertical axis of extension.

It should be noted that the transport line 4 comprises a transport element 39 to which the supporting seats 5 are connected to be moved along the first path P.

It should be noted that the transport element 39 is closed in a loop around movement means 17 which rotate about vertical axes for moving the transport element 39.

Preferably, the transport element 39 is a chain 40 comprising a plurality of links, hinged to one another in succession about corresponding vertical axes, to form an endless loop.

It should be noted that at least one of the links comprises at least one supporting seat 5 with a vertical axis for corresponding rigid container 2 which can be positioned with the opening 31 facing upwards.

It should be noted that the chain 40 may comprise both links having a corresponding supporting seat 5 and connecting links which are not provided with supporting seats 5 and which are interposed between links provided with supporting seats 5.

Therefore, preferably, a certain number of links comprises each supporting seat 5.

Preferably, but not necessarily, the movement means 17 rotate continuously about vertical axes to allow the transport element 39 to move continuously.

Described below is the station SR for filling the rigid, cup-shaped containers 2.

The station SR for filling the rigid, cup-shaped containers 2 comprises:

- at least a first containing seat S1 designed to receive a dose 33 of product;
- a substation ST1 for forming the dose 33 inside the first containing seat S1, provided with a device 6 for releasing a predetermined quantity of product forming the dose 33 inside the first containing seat S1;
- at least a second containing seat S2 designed to receive the dose 33 of product from the first containing seat S1;
- a substation ST2 for transferring the dose 33 of product from the first containing seat S1 to the second containing seat S2;
- devices 7 for moving the first containing seat S1 between the forming substation ST1 and the transfer substation ST2 and vice versa;
- a substation ST3 for releasing the dose 33 of product from the second containing seat S2 to a rigid, cup-shaped container 2 transported by the transport line 4;
- further devices 8 for moving the second containing seat S2 between the transfer substation ST2 and the release substation ST3 and vice versa.

More specifically, in one aspect, the release device comprises at least one rotary unit, designed to rotate about a respective axis of rotation to release the product inside the at least one first containing seat. All the above-mentioned components forming part of the filling station SR of the rigid, cup-shaped containers 2 are described below in more detail, with particular reference to the accompanying drawings.

It should be noted that the devices 7 for moving the first containing seat S1 comprise a first element 9 rotating about a first axis X1 of rotation which is substantially vertical, on which is connected the first containing seat S1 to be rotated about the first vertical axis X1 of rotation.

Preferably, the first rotary element 9 comprises a wheel 9*a*, connected to respective means for driving the rotation.

More specifically, preferably, the filling station SR comprises a plurality of first seats S1.

The first seats S1 are connected radially to the first rotary element 9 (more precisely to the wheel 9*a*) to be rotated with it.

Preferably, the first seats S1 are made directly in the first rotary element 9, in particular they are made directly in the wheel 9*a*.

It should be noted that the first seats S1 are positioned along an arc of a circle, preferably along a circumference having as the centre a point of the first axis X1.

Still more preferably, the first seats S1 are angularly equispaced from each other along a circumference having as the centre a point of the first axis X1.

It should also be noted that each first seat S1 follows a second path P1 different from the first path P, preferably circular having as the axis of rotation the first axis X1 in such a way as to engage cyclically—during rotation—the substations for forming (ST1) and transferring (ST2) the dose.

Alternatively, the first seats S1 are connected to the first rotary element 9 by means of a rod (not illustrated), which is movable radially relative to the first rotary element 9.

Each first seat S1 is defined, preferably, by lateral walls of a cavity 18 and by a bottom wall F. Preferably, the cavity 18 is a cylindrical cavity.

Furthermore, still more preferably, the cavity 18 has a vertical axis of extension (parallel to the first axis X1 of rotation).

Again, preferably, the filling station SR comprises, for each first seat S1:

- a piston 13, which is movable between a lower position where it defines the bottom wall F of the first seat S1 and an upper position in which fully occupies the space of the first seat S1, or in other words, closes the top of the cavity 18;
- means 14 for moving the piston 13, configured for moving the piston 13 between the above-mentioned lower and upper positions.

Examples of movement means 14 are electric motors, pneumatic devices, cam devices, and other prior art devices.

It should be noted that the expression "the piston 13 fully occupies the space" means that the piston 13 is positioned in the seat so as not to allow the presence of the dose 33 inside the first seat S1.

Preferably, the filling station SR comprises movement means 14 which are independent for each piston 13, so that each piston can be moved independently of the others.

Preferably, the cavities 18 are through cavities and the pistons 13 are movable in a linear fashion inside the cavities 18, for varying the space of the first seats S1 (lower position) and for expelling the doses 33 from the first seats S1 (upper position).

The forming ST1 and transfer ST2 substations are positioned along the periphery of the first rotary element 9 in such a way as to be engaged cyclically by the first seats S1 during rotation around the first axis X1.

More specifically, the forming ST1 and transfer ST2 substations are arranged in a predetermined position relative to a frame 29 of the filling station SR, along the second movement path P1 of the first seat S1.

In this regard, it should be noted that in a complete rotation of the first rotary element 9 each of the first seats S1 is positioned in the forming substation ST1 and, subsequently, in the transfer substation ST2.

Preferably, the second movement path P1 is closed. Preferably, the second movement path P1 is a circular path around the first axis X1.

Still more preferably, the second path P1 lies on a horizontal plane.

Described below is the substation ST1 for forming the dose 33.

The substation ST1 for forming the dose 33 is positioned in a region R1 for forming the dose 33.

With reference to the substation ST1 for forming the dose 33, it should be noted that at that substation there is the release device 6, designed for releasing a predetermined quantity of product (defining the dose 33) inside the containing seat S1 positioned in the region R1 for forming the dose 33. The releasing device 6 comprises a hopper 38 (filled, in use, with product) having at the bottom an outfeed 19 for the product. The outfeed 19 is located immediately above the containing seat S1 at the region R1 for forming the dose 33. It should be noted that the outfeed 19 is configured to create a layer of product at the region R1 for forming the dose 33 above the first seats S1, so as to release the product inside the first seat(s) S1 positioned, each time, in the forming region R1.

More specifically, the outfeed 19 of the hopper 38 is shaped in such a way as to occupy a portion of the second movement path P1 of the first seats S1.

More specifically, the outfeed 19 is in the form of a arc, centred on the first axis X1.

Preferably, the outfeed 19 in the shape of an arc has a plan width substantially equal to the diameter of the containing seats S1, so as to avoid build-ups of product inside the hopper 38.

It should also be noted that the outfeed 19 of the hopper 38, in the preferred embodiment, releases the product at a plurality of first seats S1 positioned temporarily in the region R1, that is to say, opposite below the outfeed 19. The piston 13 occupies the lower position in at least one stretch of the region R1 for forming the dose 33.

In other words, the first seats S1, passing below the hopper 38, are filled with product, in a filling time which depends on the speed of transit of the first seats S1 in the forming region R1 and on the amplitude of the portion of the second movement path P1 of the first seats S1 occupied by the outfeed 19 of the hopper 38. With reference to the movement of the piston 13 in the region R1 for forming the dose, the following should be noted.

Preferably, the piston 13 associated with the first seat S1 is positioned in the upper position where it prevents the filling of the first seat S1 (in this upper position the piston 13 closes the top of the seat 18 which defines the first seat S1) until the first seat S1 has completely entered inside the region R1 for forming the dose, at an infeed zone of the region R1 for forming the dose.

Also, preferably, when the above-mentioned first seat S1 is inside the region R1 for forming the dose, in particular at the infeed zone, the piston 13 associated with the first seat S1 is moved from the upper position to a lower end position.

The first seat S1 is therefore filled not only by gravity acting on the product which causes the product to enter the seat S1 but also due to the suction effect on the product caused by the movement (displacement) of the piston 13 from the upper position to the lower end position.

In this way, advantageously, thanks to the additional suction effect, the resulting speed of the machine 100 at the filling station SC, in particular at the substation ST1 for forming the dose, is particularly high.

It should be noted that in this lower end position, the first seat S1 defines a first space.

Preferably, during the movement of the first seat S1 inside the forming region R1, in particular at a zone positioned between the infeed zone in the region R1 for forming the dose and an outfeed zone of the region R1 for forming the dose, the piston 13 associated with the seat S1 may advantageously be moved from the lower end position to a dosing position, located between the lower end position and the upper position.

It should be noted that the piston 13, in the above-mentioned dosing position, forms with the side walls of the first seat S1 a predetermined space for containing a desired quantity of product (this space is less than the first space which is defined at the lower end position).

The fact of having firstly the piston in the lower end position, in which it defines a first containment space, and then the piston 13 in the dosing position means that the powder deposited inside the first seat S1 undergoes a first compression in the region R1 for forming the dose. The first compression contributes to rendering uniform the placing the powder inside the seat and increasing the apparent density of the powder.

According to one embodiment illustrated in the accompanying drawings, the release device 6 comprises at least a first rotary element 40*a*, designed to rotate about its axis of rotation X4. The axis of rotation X4 of the first rotary element 40*a* is stationary relative to the hopper 38, or equally, to the frame 29. The first rotary element 40*a* is configured to create a flow of product flowing out from the outfeed 19 of the hopper 38 which intercepts the at least one first seat S1 and to release the product inside the at least one first containing seat S1 in transit through the region R1 for forming the dose.

Advantageously, the flow of product intercepts the at least one first seat S1 at the infeed zone of the region R1 for forming the dose.

It should be noted that, preferably, the first rotary element 40*a* is operating in the region R1 for forming the dose on a plurality of seats S1 simultaneously (on the seats S1 temporarily in transit through the forming region R1).

It should be noted that the first rotary element 40*a* is operating in the region R1 for forming the dose 33, to release the product inside the first containing seat S1 in transit through the region R1.

It should be noted that the release device 6 also comprises drive means (such as, for example, a first drive unit 43*a*), operatively coupled to the first rotary element 40*a* to rotate the rotary element 40*a*.

The first rotary element 40*a* preferably comprises an element 41*a* which defines a surface with a helical extension.

The helical surface extends—in a spiral shape—along the axis of rotation X4 of the first rotary element 40*a*.

The first rotary element 40*a* also comprises a respective first shaft 42*a*, to which the element 41*a* is connected, defining a surface with a helical extension for being rotated.

The first shaft 42*a* is supported rotatably relative to the frame of the filling unit 1.

The first shaft 42*a* extends along the axis of rotation X4 of the first rotary element 40*a*.

It should also be noted that the first rotary element 40*a* described above defines a screw feeder, which by rotation about the axis of rotation X4 allows a feeding of the product along the direction defined by the axis of rotation X4.

With reference to the axis of rotation X4 of the first rotary element 40*a*, the following should be noted.

Figure 13:
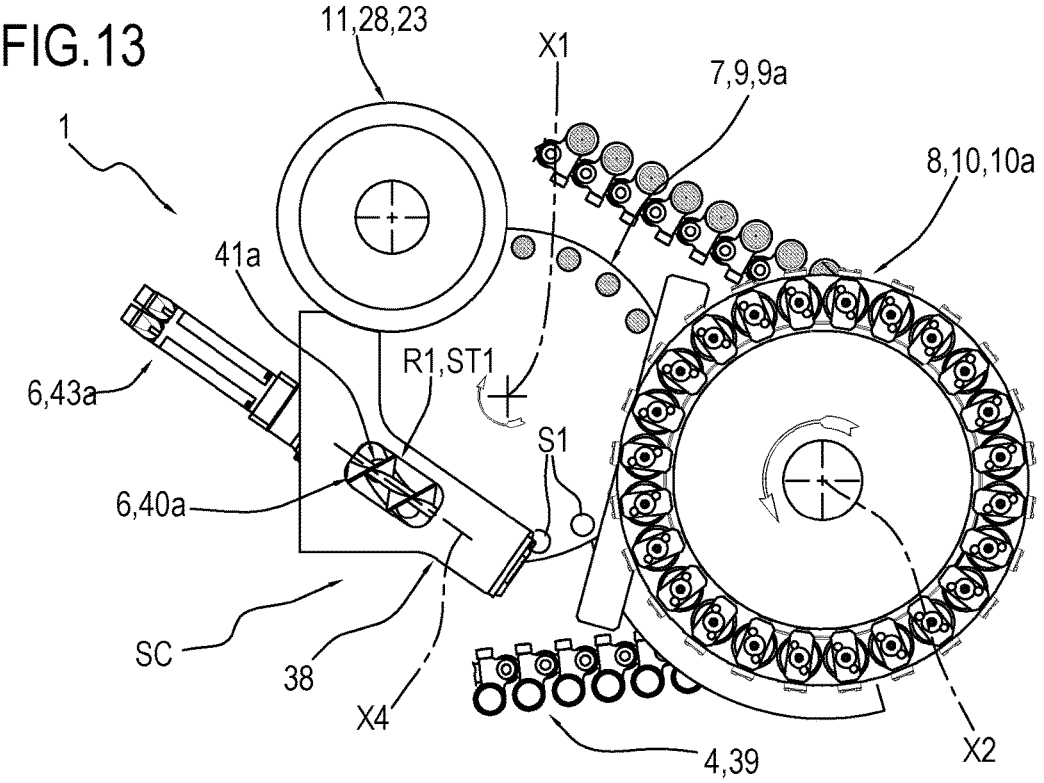
FIGS. 13 and 14 are plan views and partial cross sections, respectively, of the filling unit according to the invention in a further embodiment.
Figure 14:
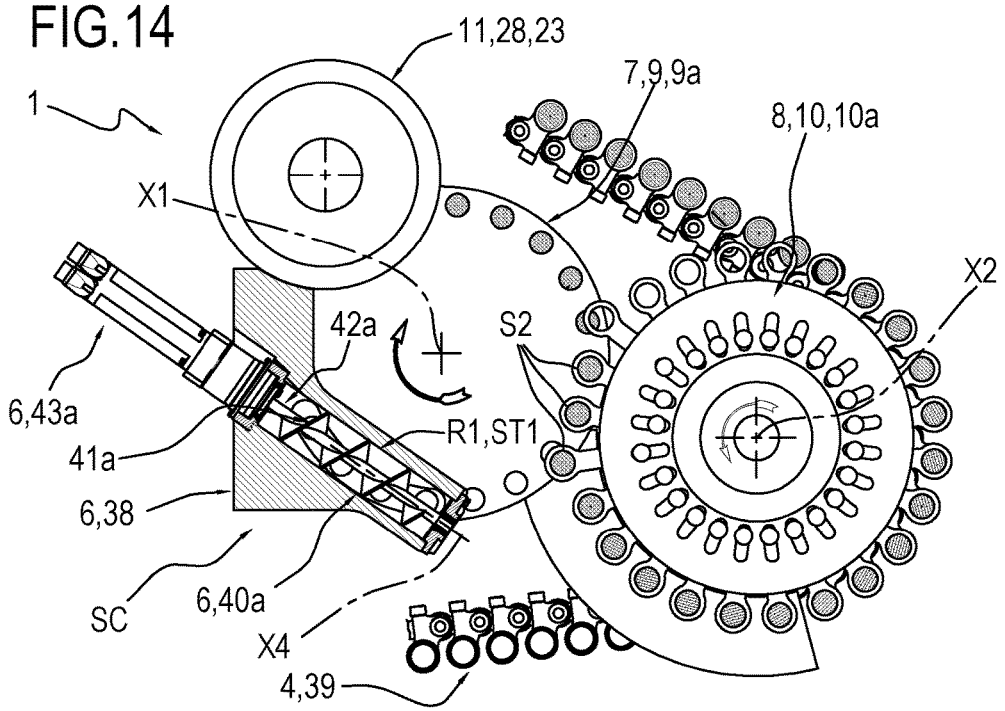

According to a first embodiment, illustrated in the FIGS. 13 and 14, the axis of rotation X4 of the first rotary element 40*a* is horizontal.

It should be noted that according to a second embodiment, not illustrated in the accompanying drawings, the axis of rotation X4 of the first rotary element 40*a* is vertical.

Figure 18:
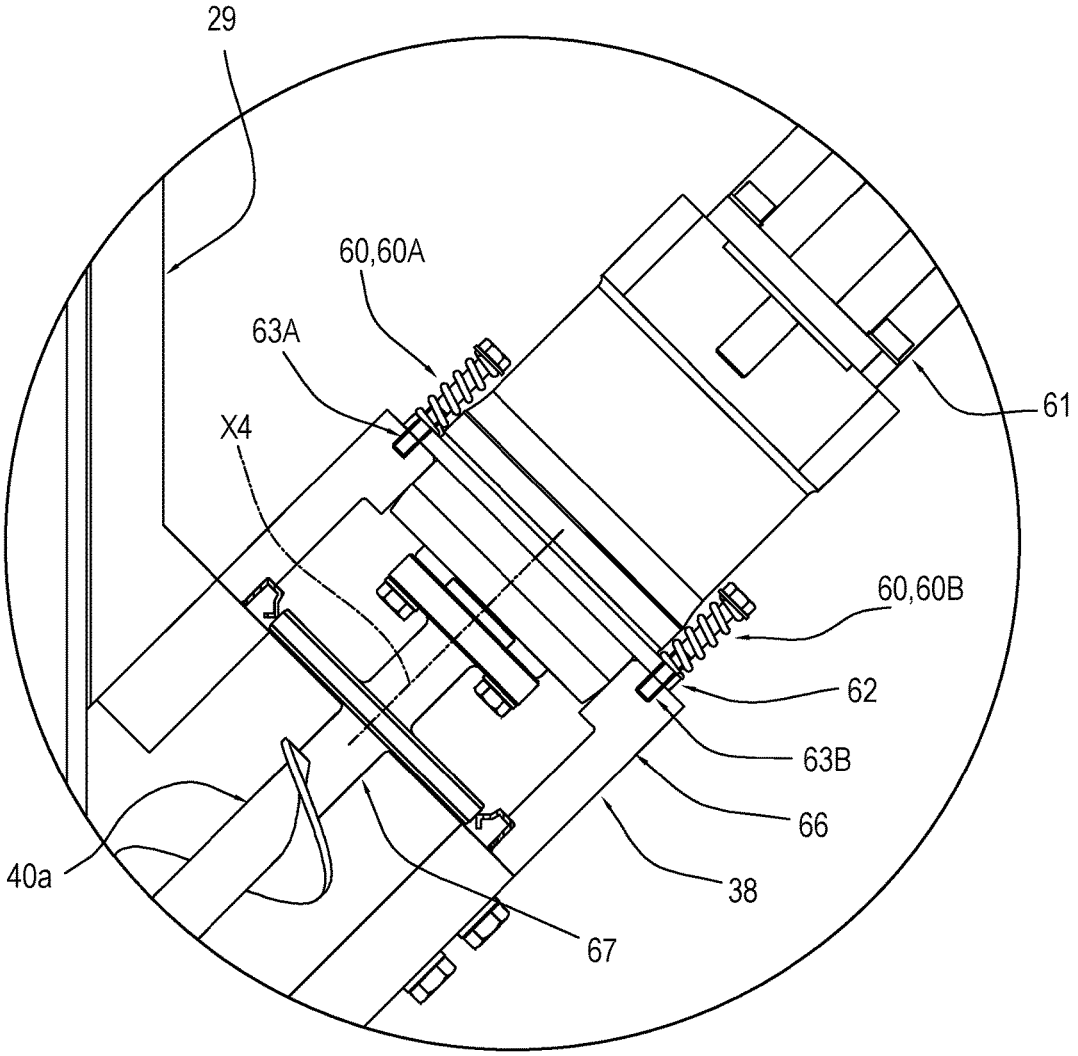
FIG. 18 illustrates a variant embodiment of a detail of the filling unit of the preceding figures.

According to a further embodiment illustrated in FIG. 18, the axis of rotation X4 of the first rotary element 40*a* is inclined relative to a horizontal plane. It should be noted that, in this alternative embodiment, the product is fed by the first rotary element 40*a* angularly, according to the direction of extension of the axis of rotation X4 so that the motion of the product has, as well as a horizontal component, a vertical component which favours the insertion of the product inside the first seat S1 in transit through the region R1 for forming the dose (slightly compressing the product inside the first seat S1).

Advantageously, therefore, the fact that the axis X4 of the first rotary element 40*a* is angularly positioned makes it possible to optimize the filling the first seat S1.

With specific reference to the embodiment illustrated in FIGS. 13 and 14, it should be noted that the helical element 41*a* of the first rotary element 40*a* comprises a first end, positioned at the infeed zone of the region R1 for forming the dose, and a second end opposite to the first end.

The helical element 41*a* of the first rotary element 40*a* is rotated in such a way that the product is pushed, along the direction of extension of the axis of rotation X4, in the direction from the second end towards the first end.

Basically, the rotation of the helical element 41*a* of the first rotary element 40*a* creates a flow of product inside the hopper 38, which intercepts the first seat S1 to be filled, so that the first seat S1 is filled at the first end of the helical element 41*a*.

In other words, the first end of the helical element 41*a* is positioned at the infeed zone of the region R1 for forming the dose.

More specifically, the first rotary element 40*a* pushes the product from a zone inside the region R1 for forming the dose towards the infeed area of the region R1 for forming the dose.

It should be noted that the first rotary element 40*a* defines a unit for feeding the product inside the first seat S1.

Figure 15:
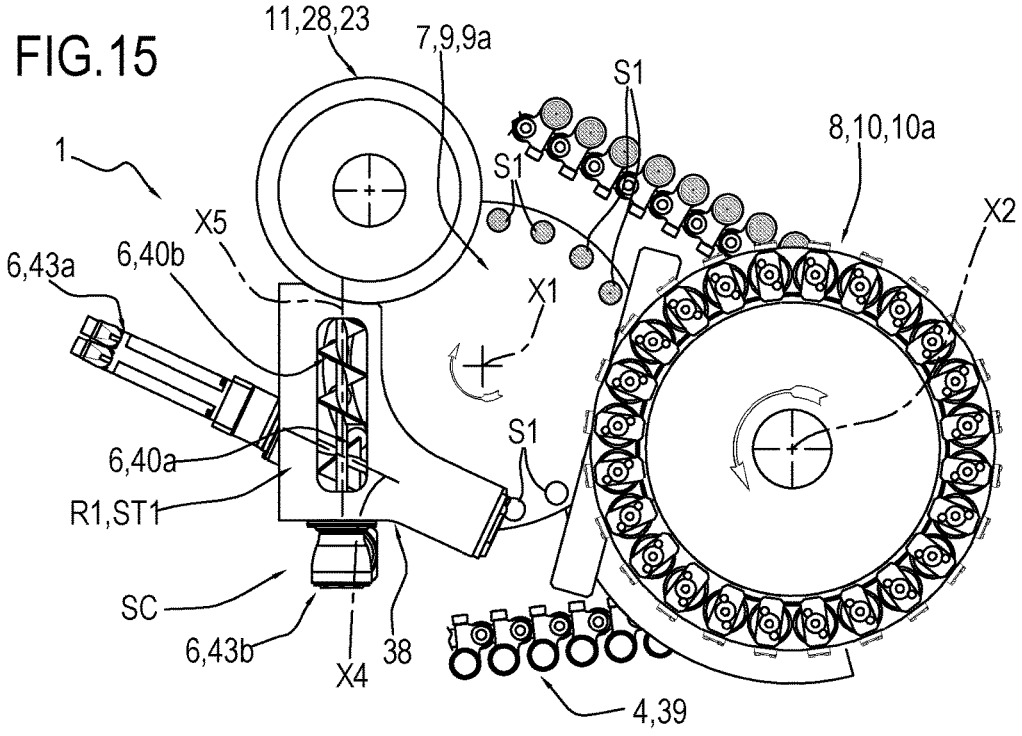
FIGS. 15 and 16 are plan views and partial cross sections, respectively, of the filling unit according to the invention in a further embodiment.
Figure 16:
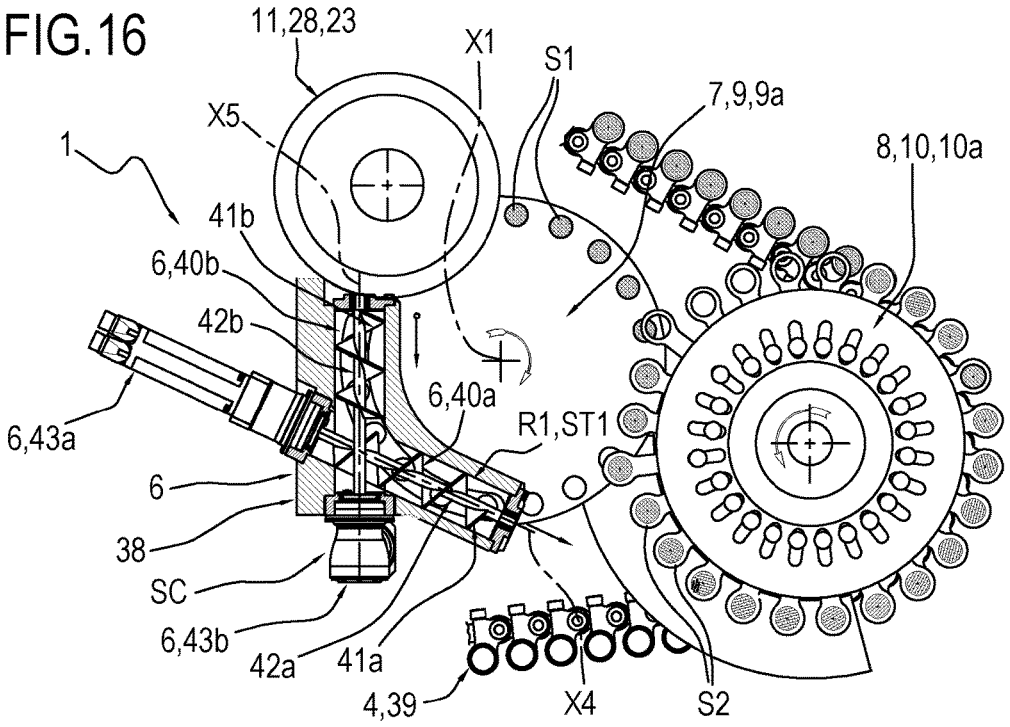
Figure 17:
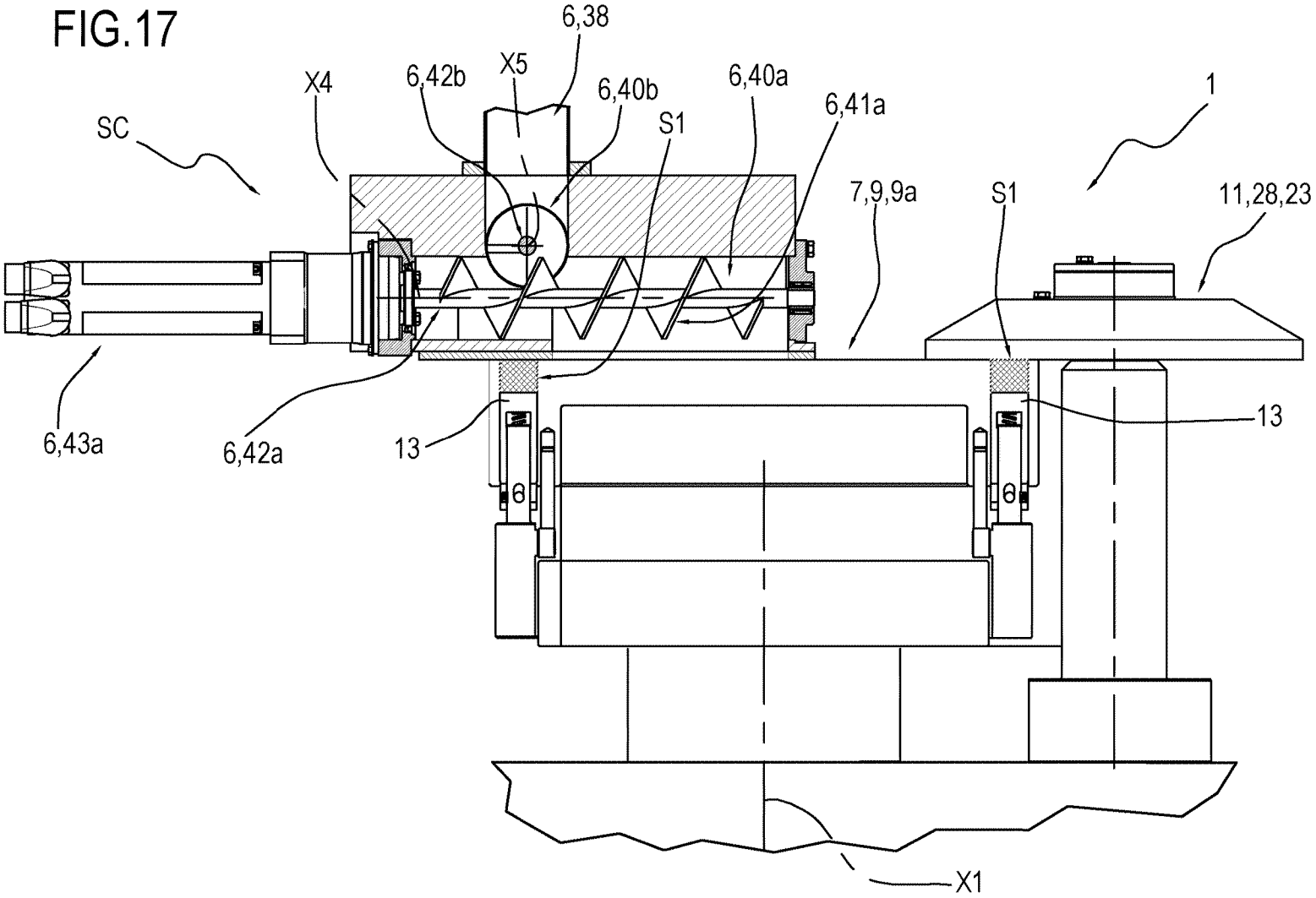
FIG. 17 is a side view in partial cross section of the filling unit of FIGS. 15 and 16.

FIGS. 15 to 17 illustrate a variant embodiment in which the release device 6 comprises, in addition to the first rotary element 40*a*, a second rotary element 40*b*, designed to rotate about a relative further axis of rotation X5.

It should be noted that the release device 6 also comprises drive means (such as, for example, a second drive unit 43*b*), operatively coupled to the second rotary element 40*b* to rotate the second rotary element 40*b*.

The further axis of rotation X5 of the second rotary element 40*b* is stationary relative to the hopper 38, or, equally, to the frame 29. The second rotary element 40*b* is designed to create a recycle flow of product.

It should be noted that each of the two rotary elements (40*a*, 40*b*) is equipped with a respective helical element (41*a*, 41*b*) and a respective shaft (42*a*, 42*b*), to which a respective helical is connected for being rotated.

The second shaft 42*b* is supported rotatably relative to the frame of the filling unit 1.

The second shaft 42*b* extends along the further axis of rotation X5 of the second rotary element 40*b*.

It should also be noted that the second rotary element 40*b* described above defines a screw feeder, which by rotation about the further axis of rotation X5 allows a feeding of the product along the direction of axial extension defined by the further axis of rotation X5. It should be noted that the shafts (42*a*, 42*b*) of the first and the second rotary element (40*a*, 40*b*) are offset from each other.

More specifically, preferably, the shafts (42*a*, 42*b*) of the first and the second rotary element (40*a*, 40*b*) are positioned at different heights to each other.

Preferably, the shaft 42*a* of the first rotary element 40*a* is positioned below the second shaft 42*b* of the second rotary element 40*b* (as is shown in FIG. 17).

The shafts (42*a*, 42*b*) of the first and the second rotary element (40*a*, 40*b*) are superposed on each other at a superposing zone.

With regard to the second rotary element 40*b*, attention is drawn to the following. The helical element 41*b* of the second rotary element 40*b* extends between a first end, positioned at an outfeed zone of the region R1 for forming the dose, and a second end opposite the first.

The second end of the helical element 41*b* is positioned, starting from the outfeed zone of the transfer region R1, upstream of the superposing zone of the two shafts (42*a*, 42*b*): this means that the respective helical elements (41*a*, 41*b*) of the first rotary element 40*a* and the second rotary element 40*b* can freely rotate, without interfering with each other.

According to alternative embodiments, the shaft 42*b* of the second rotary element 40*b* is positioned horizontally, or at an angle to a horizontal plane.

In the embodiment illustrated in FIGS. 15 to 17, both the first shaft 42*a* of the first rotary element 40*a*, and the second shaft 42*b* of the second rotary element 40*b* are positioned horizontally.

In an alternative embodiment not illustrated, the second shaft 42*b* of the second rotary element 40*b* is positioned at an angle to a horizontal plane and the first shaft 42*a* of the first rotary element 40*a* is horizontal.

In a further alternative embodiment not illustrated, the second shaft 42*b* of the second rotary element 40*b* is horizontal and the first shaft 42*a* of the first rotary element 40*a* is positioned at an angle to a horizontal plane.

Alternatively, in yet another embodiment not illustrated, both the second shaft 42*b* of the second rotary element 40*b* and the first shaft 42*a* of the first rotary element 40*a* are positioned at an angle relative to a horizontal plane, advantageously mutually parallel.

It should be noted that the second rotary element 40*b* is rotated in such a way that the product is pushed along the direction of extension of the further axis of rotation X5 in the direction from the first end towards the second end.

In the embodiment illustrated in FIGS. 15-17, the second rotary element 40*b* pulls the product from the outfeed zone of the region R1 for forming the dose towards a zone inside the region R1 for forming the dose. In other words, the second rotary element 40*b* recirculates the product which accumulates by the effect of a levelling element 22 (illustrated in more detail below), from the outfeed zone of the region R1 for forming the dose to the first rotary element 40*a*.

In other words, the first rotary element 40*a* performs dosing functions, whilst the second rotary element 40*b* performs recycling functions.

With specific reference to the functionality of the second rotary element 40*b*, it should be noted that the second rotary element 40*b* pulls the product along the direction of extension of the further axis of rotation X5 from the outfeed zone of the region R1 for forming the dose towards a zone inside the region R1 for forming the dose, where the first rotary element 40*a* is positioned; preferably, the second rotary element 40*b*, pulls the product located above a predetermined height from the top edge defined by the first seat(s) S1.

According to yet another aspect, it should be noted that the control unit 15 of the machine 100 is designed to rotate the at least one first rotary element 40*a* of the release device 6 with a speed depending on the speed of movement of the first seat S1 by the first rotary unit 9 about the first of rotation axis X1.

Further, according to another aspect of the invention, the control unit 15 of the machine 100 is designed to rotate the at least one first rotary element 40*a* of the release device 6 with variable speed as a function of the quantity of product to be inserted inside each first seat S1. More in detail, it is possible to increase the quantity of product inserted inside each seat by increasing the speed of rotation of the first rotary element 40*a*, in such a way as to increase the apparent density of the product, and vice versa.

In other words, it is possible to vary the quantity of product contained in the first seat S1, and hence in the capsules 3, by adjusting the speed of rotation of the at least one first rotary element 40*a*.

Again with reference to the release device 6 as shown in FIGS. 13 to 17, it should be noted that the rotary element (40*a*, 40*b*) is associated with (located inside) the hopper 38, which also forms part of the release device 6.

It should be noted that the hopper 38 is defined by corresponding side walls, which are vertical and/or inclined. More specifically, in the embodiment shown in FIGS. 15, 16 and 17, the filling unit 1 comprises a hopper 38 to which the first rotary element 40*a* and the second rotary element 40*b* are associated (positioned inside).

However, with reference to the embodiment shown in FIGS. 13 and 14, the filling unit 1 comprises a hopper 38 to which the first rotary element 40*a* is associated (positioned inside).

It should be noted that, advantageously, the presence of one or more rotary elements (40*a*, 40*b*) prevents the product, in particular with powder type products (such as, for example, coffee), from creating blockages, that is, build-ups, inside the hopper which render incomplete the filling of the first seats S1 in transit through the region R1 for forming the dose.

Indeed, it should be noted that the one or more rotary elements (40*a*, 40*b*) are rotated so as to move the product and prevent the formation of any blockage inside the hopper 38 for feeding the product.

In this way, advantageously, the speed at which the unit 1 may be used is particularly high and, consequently, the unit 1 is particularly fast and reliable in its operation.

According to another aspect, it should be noted that the release device 6 is also equipped with a levelling device 22, located in such a way as to prevent the product being dispersed out of the region R1 for forming the dose 33, except for the product contained in the first seats S1, that is, the individual doses 33.

Basically, the levelling element 22 and the piston 13 define the dose 33 contained in the first seats S1.

According to the invention, by varying the position of the piston 13 by means of the movement means 14 in the region R1 for forming the dose 33 it is possible to vary the quantity of product contained in the first seats S1, or in other words, it is possible to vary the dose 33. Basically, the movement means 14 are designed to position the piston 13 in a dosing position, located between the lower position and the upper position, at the outfeed zone of the region R1 for forming the dose 33, to define the dose 33 in conjunction with the levelling element 22

Preferably, in the embodiment illustrated, the filling station SR comprises a substation ST4 for compacting the dose 33.

The substation ST4 for compacting the dose 33 is positioned in a compacting region R4, along the second movement path P1 of the first seat S1 between the forming substation ST1 and the transfer substation ST2. The substation ST4 is optional and can be omitted.

More specifically, the compacting substation ST4 is equipped with compacting means 11 designed to compress the product, in phase with the piston 13, inside the first seat S1.

The compacting means 11 are described below in more detail.

In the example described, the compacting means 11 comprise a compacting element 28.

The compacting element 28 in the preferred embodiment illustrated comprises a compacting disk 23.

It should be noted that the compacting element 28 is connected to the (carried by the) frame 29 of the filling station SR.

The compacting element 28 is positioned on top of the first seats S1 at the compacting region R4.

It should be noted that the compacting element 28 comprises an upper face and a lower face. Preferably, the lower face is a planar face.

It should be noted that the lower face of the compacting element 28 defines, at the compacting region R4, an upper contact element of the dose 33 positioned inside the first seat S1, so as to compact the product, when the piston 13 is lifted into a compacting position, which is intermediate between the lower position and the upper position.

In other words, the means 14 for moving the piston 13 are designed to move the piston 13 from the lower position to the compacting position, that is to say, to bring the piston 13 towards the compacting element 28, in the compacting region R4, in such a way as to compact the dose 33.

It should also be noted that, according to an embodiment, the compacting element 28 is stationary relative to the frame 29.

Alternatively, according to another embodiment, the compacting element 28 is rotatably carried (supported) by the frame 29 of the filling station SR, so as to rotate about a third axis X3 of rotation.

It should be noted that, according to an embodiment, the compacting element 28 is freely rotatable about the third axis X3.

On the contrary, according to yet another embodiment not illustrated, the filling station SR comprises a drive system operatively connected to the compacting element 28 for driving the compacting element 28 in rotation about the third axis X3. It should be noted that, in this embodiment, the drive unit is driven in synchrony with the first rotary element 9.

Advantageously, the fact that it comprises a unit for driving the compacting element 28 means that it is possible—with suitable relative speeds of rotation of the compacting element 28 and of the first rotary element 9—to minimise the speed of contact between the dose 33 inside the first seat S1 and the compacting element 28 in the compacting region R4.

The filling station SR is described below with particular reference to the second seat S2, the transfer substation ST2 and the release substation ST3.

It should be noted that the filling station SR comprises, preferably, a second rotary element 10 to which the second seat S2 is associated (connected).

It should be noted that, more generally, the second rotary element 10 forms the above-mentioned further devices 8 for moving the second seat S2 between the transfer substation ST2 and the release substation ST3 and vice versa.

The second rotary element 10 is configured to rotate about a second axis X2. Preferably, the second axis is parallel to the first axis X1. More preferably, the second axis X2 is vertical.

Preferably, the filling station SR comprises a plurality of second seats S2.

It should be noted that the second seat(s) S2 are connected to the second rotary element 10 so as to be rotated by it.

It should be noted that the second rotary element 10 comprises, preferably, a second wheel 10*a*, configured to rotate about the second axis X2, to which the second seats S2 are connected.

It should be noted that, by way of a non-limiting example, the second seats S2 in the embodiment illustrated are moved along a third path P2, substantially circular, different from the second path P1. More generally, the third path P2 is closed. Preferably, the third path P2 lies on a plane (horizontal).

The third path P2 is partly superposed and, at the release region R3, parallel to the first path P.

More specifically, it should be noted that each second seat S2 is moved in a complete a rotation about the second axis X2, or more generally, around the third path P2, to the transfer station ST2 (in a transfer region R2) and to the release station ST3 (in a release region R3).

At the transfer region R2 the second seat S2 is positioned above, advantageously immediately above, the first seat S1.

More in detail, when the second seat S2 is positioned above the first seat S1 at the transfer region R2, the piston 13 is driven upwards for pushing the dose 33 of product from the first seat S1 to the second seat S2.

With reference to the second seat S2, it should be noted that preferably this seat is a through seat.

More specifically, the second seat S2 is preferably defined by a through cavity (preferably in the form of a hole). Preferably, the cavity is cylindrical.

It should be noted that side walls of the second seat S2 are defined by side walls of the through cavity.

Preferably, the second seat S2 is connected to the second rotary element 10 by means of a rod 27.

According to an embodiment not illustrated, the second seat S2 is fixed to the second rotary element 10, that is, to the second wheel 10*a*.

For this reason, according to this embodiment, the radial position of the second seat S2 is constant relative to the second axis X2. In this embodiment, the third path P2 is circular.

Preferably, in accordance with this embodiment, the plan extension of the second seat S2 is greater than the plan extension of the first seat S1 (in such a way that whilst the dose 33 of product fully occupies the space of the first seat S1, the dose 33 of product after the transfer does not fully occupy the space of the second seat S2).

It should be noted that the fact that the plan extension of the second seat S2 is greater than plan extension of the first seat S1 allows, in use, the transfer of the dose 33 from the first seat S1 to the second seat S2 in a transfer region R2 which is sufficiently large. This is particularly important for speeds of rotation of the first rotary element 9 and of the second rotary element 10 which are particularly high: in effect, the above-mentioned aspect ensures that the superposing of the second seat S2 on the first seat S1 and, therefore, the transfer of the dose 33 the first seat S1 to the second seat S2 can occur in predetermined angles of rotation of the first and the second rotary elements.

According to the embodiment illustrated, each second seat S2 is movable relative to the second rotary element 10, that is, relative to the second wheel 10*a*.

More specifically, preferably each second seat S2 is movable on a plane at right angles to the second axis X2.

Still more preferably, each second seat S2 is movable at least radially relative to the second axis X2. Therefore, in the embodiment illustrated, the third path P2, at the transfer region R2, is parallel to the second path P1.

It should be noted that the fact that the second seat S2 is movable on a plane at right angles to the second axis X2 makes it possible to extend the extension of the transfer region R2: in other words, it is possible to extend the zone where the second seat S2 superposes the first seat S1.

It should be noted that the transfer of the dose 33 from the first seat S1 to the second seat S2 is not instantaneous but is performed within an angle of rotation of the first rotary element 9 and of the second rotary element 10.

In this regard, it should be noted that the fact that the second seat S2 is movable radially relative to the second rotary element 10 allows a tracking of the first seat S1 during rotation of one or both the rotary elements (9, 10), so that it is possible to keep the second seat S2 superposed on the first seat S1 through an angle of rotation of the first rotary element 9 and the second rotary element 10 which is sufficiently large to allow the dose 33 to be transferred from the first seat S1 to the second seat S2.

In the embodiment illustrated, the plan extension of the second seat S2 may be reduced with respect to the embodiment (not illustrated) wherein the second seat S2 is fixed to the second rotary element 10, that is, to the second wheel 10*a*.

During transfer of the dose 33 from the first seat S1 to the second seat S2 the piston 13 supports the dose 33.

In another alternative embodiment not illustrated, each second seat S2 is movable relative to the second rotary element 10 that is, relative to the second wheel 10*a* both radially and in rotation about axes which are parallel to the second axis X2, that is, about vertical axes.

Advantageously, cam means may move the second seats S2 radially and in rotation relative to the second rotary element 10 that is, relative to the second wheel 10*a*.

In this further alternative embodiment not illustrated, each second seat S2 has two degrees of freedom on horizontal planes which allow the second seats S2 to perfectly follow the first seats S1 in the transfer region R2.

In other words, each second seat S2 is exactly superposed on a corresponding first seat S1 in the transfer region R2. In this further alternative embodiment not illustrated, the first seats S1 and the second seats S2 can have a plan extension which is equal.

With reference to the position of the second rotary element 10 and of the transport element 39, it should be noted that, according to the example illustrated, the second rotary element 10 and the transport element 39 are positioned in such a way that a portion of the first path P of the supporting seats 5 is—according to a plan view—superposed on a portion of the third path P2 of the second seats S2.

Preferably, the superposed portions of the path between supporting seats 5 and second seats S2 are curvilinear portions of the path (preferably arcs).

It should be noted that, according to this aspect, the release of the dose 33 from the second seat S2 to the rigid, cup-shaped container 2 occurs at the superposed portions of path.

For this reason, the release substation ST3 is positioned at the portions of the path superposed.

It should be noted that, according to an embodiment not illustrated, the transfer of the dose 33 from the second seat S2 to the rigid, cup-shaped container 2 might also occur at a rectilinear portion of the first movement path P of the supporting seats 5, that is to say, a rectilinear portion of the movement line 4 of the rigid, cup-shaped container 2.

Preferably, according to this embodiment, the second seats S2 are movable at least radially relative to the second wheel 10*a*, in such a way as to maintain the superposing of the second seat S2 with the rigid, cup-shaped container 2 at a rectilinear stretch of the line 4 which is sufficiently large.

In other words, according to this embodiment, the movement (at least radial) of the second seat S2 relative to the second wheel 10*a*/second rotary element 10 ensures that the second seat S2, during rotation of the second rotary element 10, remains superposed on the rigid, cup-shaped container 2 being fed in the transport line 4 for a rectilinear stretch sufficiently long to allow the dose 33 to be released from the second seat S2 to the underlying rigid, cup-shaped container 2.

It should be noted that the filling station SR also comprises an upper contact element 25, present in the transfer region R2, which defines an upper stop for the dose 33 (as described in more detail below).

Preferably, the upper contact element 25 is a substantially planar plate.

It should be noted that the upper contact element 25 is fixed to the frame 29 of the filling station SR, that is, it is not rotated as one with the second rotary element 10.

More specifically, the upper contact element 25 is positioned in the transfer region R2 above the second seat S2.

The functionality of the upper contact element 25 is described below.

The filling station SR also comprises a supporting element 24 positioned along the third path P2 between the transfer substation ST2 and the release substation ST3.

It should be noted that the supporting element 24 forms a base for each second seat S2, at the portion of the third path P2 where the supporting element 24 is positioned: this will become clearer below, where the operation of the filling unit according to this invention and the method according to this invention are described.

The filling station SR may comprise, advantageously, according to the embodiment illustrated, one or more pushing elements 26. The pushing elements 26 are optionals and can be omitted. Note: it is basically a rotary ejection device.

The pushing element(s) 26 is/are movable, the operate(s) on the second seat S2 at the release substation ST3.

In the embodiment illustrated, the filling station SR comprises a pushing element 26 associated with each second seat S2.

For this reason, according to the embodiment illustrated, the filling station SR comprises a plurality of pushing elements 26, one for each second seat S2.

It should be noted that the pushing elements 26 are integral with the second rotary element 10, in such a way as to be rotated with it.

In addition, the pushing element 26 is movable between a raised position, in which it is positioned above and outside the second seat S2, and a lowered position, where it protrudes below the second seat S2.

Advantageously, the pushing element 26 may be sized in such a way as to bring about a cleaning of the second seat S2 during the passage from the raised position to the lowered position. The filling station SR comprises drive means, for example cam drive means, for moving the pushing element 26 between the raised position and the lowered position.

Advantageously, the pushing element 26, passing from the raised position to the lowered position, comes into contact with the side of the side walls of the second seat S2, thereby cleaning the side walls.

It should be noted that the pushing element 26 is moved from the raised position to the lowered position at the release substation ST3 (after, or during, the release of the product), in the manner described in more detail below.

It should also be noted that, according to an embodiment, the pushing element 26 pushes, from the top downwards, and towards the outside, the dose 33 positioned inside the second seat S2, with the aim of favouring the transfer of the dose 33 from the second seat S2 to the rigid, cup-shaped container 2.

The release substation ST3 equipped with pushing elements 26 is extremely clean, more so than a station with screw feeders.

It should be noted that, according to an embodiment not illustrated, there is a single pushing element 26 positioned at the release region R3.

This single pushing element 26 is movable in order to make contact—at the end or during the step of releasing the dose 33 from the second seat S2 to the rigid container 2—with the side walls of the second seat S2 so as to carry out a cleaning.

With reference to the filling unit 1 in its entirety, it should be noted that the unit 1 also comprises a unit (formed by one or more electronic cards) for drive and control of the devices (7, 8) for moving, respectively, the first seat S1 and the second seat S2.

The drive and control unit is also configured to control the advance of the transport element 39 and the movable elements of the filling station SR (for example, the pistons 13, the pushing elements 26).

It should be noted that the drive and control unit coordinates and controls the step of moving all the above-mentioned elements connected to it, so as to allow the operations described below to be performed.

Figure 1:
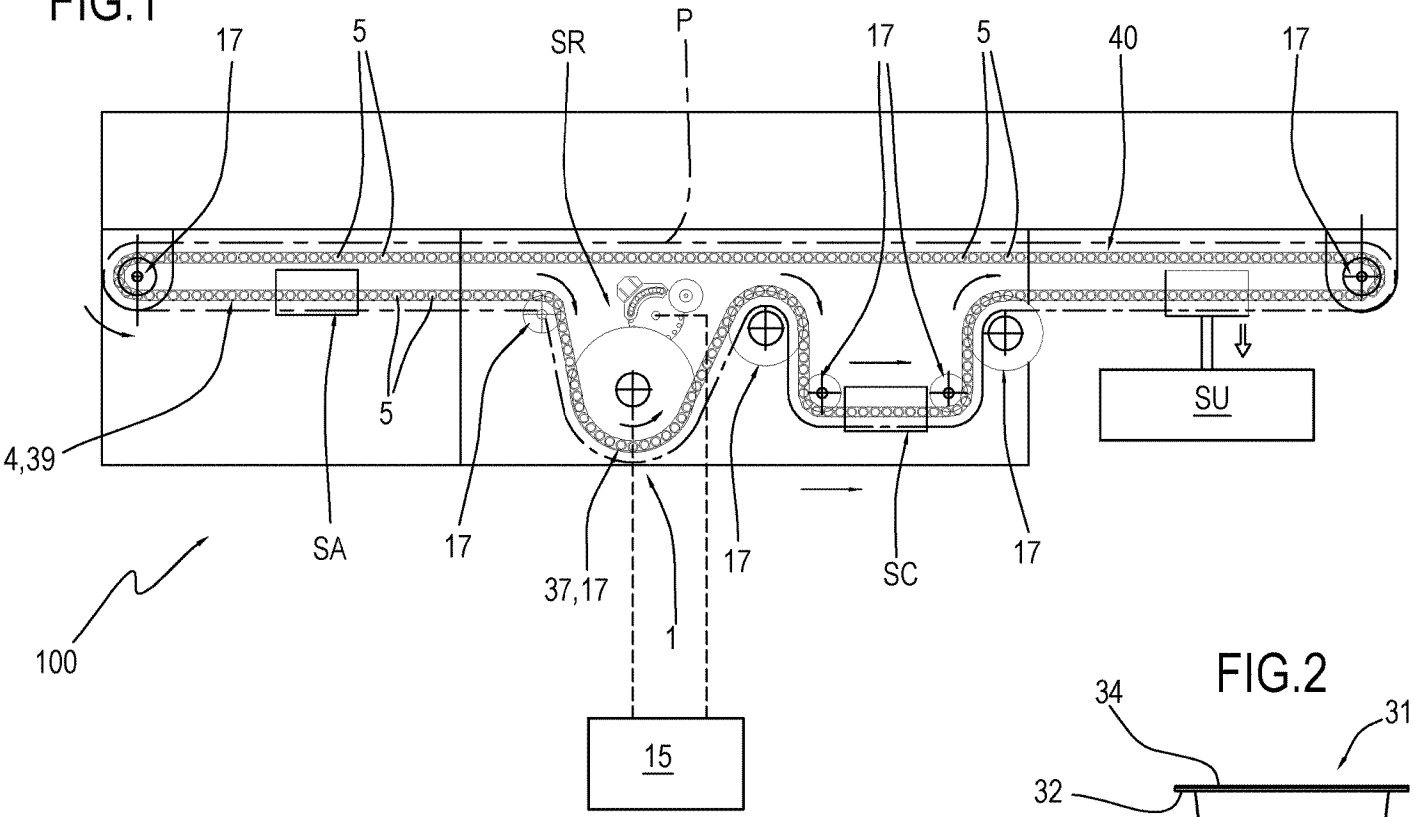
FIG. 1 is a schematic view of a machine for packaging containing elements of single-use capsules for extraction or infusion beverages comprising a filling unit according to a preferred embodiment of the invention.

The filling unit 1 according to the invention may advantageously form part of a packaging machine 100 (illustrated in FIG. 1) designed for packaging single-use capsules for extraction or infusion beverages, for example of the type described above. The packaging machine 100 further comprises a plurality of stations, positioned along the first path P performed by the transport element 39, configured to operate in a synchronised fashion (preferably continuously) with the transport element 39 and with the filling station SR, comprising at least:

- a station SA for feeding rigid containers 2 into corresponding seats 5 of the transport element 39;
- a station SC for closing the rigid containers, in particular the upper opening 31 of the rigid container 2, with a lid 34;
- an outfeed station which picks up the capsules 3 from the respective seats 5 of the transport element 39.

In addition to the stations listed above (SA, SR, SC, SU), the packaging machine 100 may comprise further stations, such as, for example, one or more weighing stations, one or more cleaning stations, one or more control stations and, depending on the type of capsule to be packaged, one or more stations for applying filtering elements.

The operation of the filling unit 1 is briefly described below, in particular the filling station SR, with the aim of clarifying the scope of the invention: in particular, the filling of a rigid, cup-shaped container 2 is described with reference to the embodiment illustrated in the accompanying drawings.

During movement (rotation) of the first rotary element 9, a first seat S1 designed to be filled with a dose 33 of product is positioned in the region R1 for forming the dose 33, that is to say, in the proximity of the station ST1 for forming the dose 33.

It should be noted that the hopper 38 feeds product in the region R1 for forming the dose 33, which falls in, and fills, the first seat S1.

The movement of the first rotary element 9 is, preferably, a continuous type movement. Alternatively, the movement of the first rotary element 9 is of a step type.

More specifically, the first seat S1 is completely filled at the outfeed of the region R1 for forming the dose 33.

It should be noted that at the outfeed of the region R1 for forming the dose 33, the levelling device 22 allows excess product (for example, powder or leaves) to be removed, in such a way that the first seat S1 is completely filled, or in other words, that the dose 33 comprises a surface formed by the levelling device 22.

Advantageously, the filling unit 1 can operate a step for compacting the dose 33. The compacting step is optional and can be omitted.

In the compacting step, if present, when the first seat S1 is positioned—by the rotation of the first rotary element 9—at the compacting substation ST4, the dose 33 of product inside the first seat S1 is subjected to compacting.

More in detail, the dose 33 of product inside the first seat S1 is pushed by the piston 13 upwards when the piston 13 is raised from the lower position to the compacting position, so that an upper part of the dose 33 makes contact with a lower face of the compacting disk 23, and the dose 33 is compacted inside the first seat S1. It is clear that the more the piston 13 is raised, that is to say, moved close to the compacting disk 23, the more the dose 33 is compacted.

Following a further rotation of the first rotary element 9, the first seat S1 is positioned at the transfer region R2, in which the transfer substation ST2 is present.

It should be noted that, due to the rotation of the second rotary element 10, a second seat S2 is positioned at the transfer region R2, for receiving the dose 33 from the first seat S1.

In this regard, FIGS. 9 to 12 illustrate—in a side view—a sequence of operations which are performed at the transfer region R2.

It should be noted that, preferably, the first rotary element 9 and the second rotary element 10 are moved during transfer of the dose 33 of product from the first seat S1 to the second seat S2.

In this regard, during the operating cycle the first rotary element 9 and the second rotary element 10 are, preferably, driven continuously.

It should be noted that, at the transfer region/substation (R2/ST2) the piston 13 is moved from the lowered position, wherein it defines the bottom F the first seat S1, to the raised position, so as to transfer the dose 33 from the first seat S1 to the second seat S2.

In order to perform the transfer, for a period of time depending on the speed of rotation of the respective first and second rotary elements (9, 10), the second seat S2 and the first seat S1 are superposed (at different heights) at the transfer region R2.

In the drawings from 9 to 11, the second seat S2 is positioned above the first seat S1.

Figure 9:
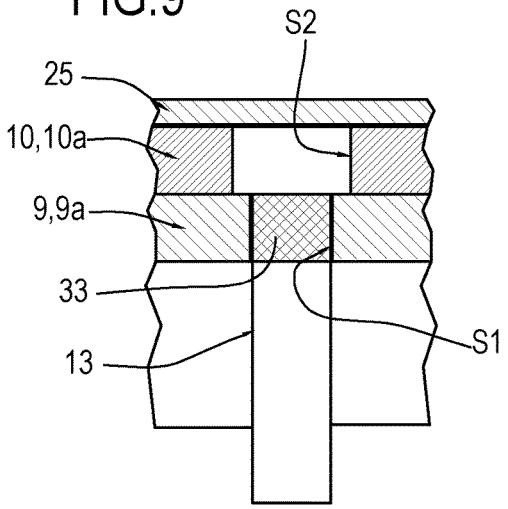
FIGS. 9 to 12 schematically illustrate some operating steps of a method according to the invention performed in the filling station of the filling unit according to the invention.
Figure 10:
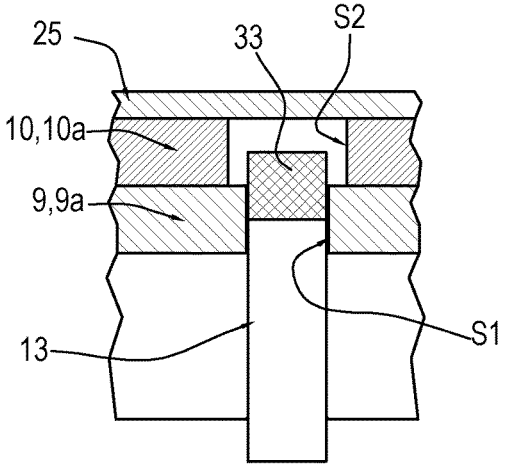
Figure 11:
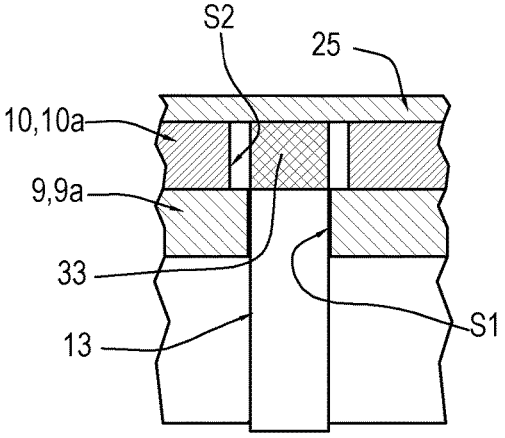
Figure 12:
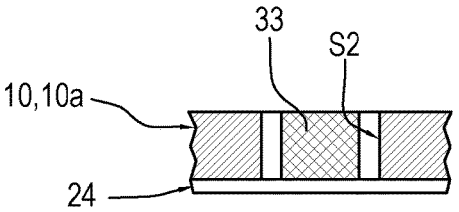

It should be noted that, during transfer from the first seat S1 to the second seat S2 that is, at the transfer region R2, according to a plan view, the area occupied in plan by the first seat S1 is positioned inside the area occupied in plan by the second seat S2 (however, the first seat S1 and second seat S2 are positioned at different heights: the second seat S2 is positioned higher than the first seat S1 as shown in the accompanying FIGS. 9 to 11).

The step of transferring the dose 33 of product from the first seat S1 to the second seat S2 comprises a step for pushing the dose 33, using the piston 13, from the first seat S1 to the second seat S2 (FIG. 10).

It should be noted that the upper contact element 25, present at the transfer region R2, defines an upper stop for the dose 33 of product, in such a way as to substantially prevent the escape of the dose 33 of product from the second seat S2 following the pushing action of the piston 13 (as illustrated in FIG. 11).

The upper contact element 25 is fixed to the frame 29 of the machine, that is, it is not rotated as one with the second rotary element 10.

The piston 13 in the position of escape from the first seat S1 defines, temporarily, the bottom of the second seat S2 that is, it allows the product to be supported inside the second seat S2.

The further rotation of the second rotary element 10 ensures that the second seat S2 makes contact with the bottom of the supporting element 24.

The supporting element 24 therefore replaces the piston 13 in defining the bottom of the second seat S2.

At this point, the piston 13 lowers so as to enter the first seat S1.

The first seat S1, following the further rotation of the first rotary element 9, is positioned again at the forming station ST1 of the dose 33, where the piston 13 again adopts the lower position in which it defines the bottom of the first seat S1.

The supporting element 24 is fixed to the frame 29 of the machine, that is, it is not rotated as one with the second rotary element 10.

For this reason, the dose 33, positioned inside the second seat S2, is supported below by the supporting element 24 for a predetermined angular stroke of the second rotary element 10 and moved from the second seat S2 along the third path P2.

In other words, the dose 33 of product inside the second seat S2 slides on, and is supported by, the supporting element 24 for a predetermined angular stroke of the second rotary element 10.

It should be noted that where the supporting element 24 ends there is the release substation ST3.

At the release substation ST3, the dose 33 is released from the second seat S2 to a rigid, cup-shaped container 2 positioned, at the release substation ST3, below the second seat S2.

The release substation ST3 extends along a predetermined portion of the third movement path P2 of the second seats S2.

It should be noted that the releasing step is performed preferably whilst the second element 10 is in rotation and the transport line 4 is actuated, that is to say, whilst both the second seat S2 and the rigid, cup-shaped container 2 are moved.

The release step is described below.

It should be noted that, during the release, the second seat S2 is superposed on the cup-shaped container 2, so that it is possible to transfer—by falling, or pushing, from the top downwards—the dose 33 from the second seat S2 to the cup-shaped container 2.

According to a preferred embodiment, the release of the dose 33 from the second seat S2 to the cup-shaped container 2 is achieved simply by dropping the dose 33 by gravity once the second seat S2 is superposed on the cup-shaped container 2, and the supporting element 24 has ended and no longer supports the dose 33.

Moreover, during this releasing step or immediately after, the pushing element 26 penetrates—from the top downwards—into the second seat S2, in such a way as to scrape the side walls of the second seat S2 in order to exert a cleaning action.

If the simple force of gravity is insufficient to allow the transfer of the dose 33, the pushing element 26 may exert a pushing action—from the top downwards—on the dose 33 of product inside the second seat S2, in such a way as to favour the escape of the dose 33 from the second seat S2 and allow the falling, that is, the release, inside the rigid, cup-shaped container 2.

It should be noted that, according to this aspect, the pushing element 26 penetrates—from the top—inside the second seat S2, pushing the dose 33 from the top downwards towards the rigid, cup-shaped container 2.

The action of the pushing element 26 therefore substantially has, in this case, a dual purpose: a cleaning of the second seat S2 and the detachment and therefore the falling of the dose 33 of beverage from the second seat S2 to the rigid, cup-shaped container 2.

Next, the pushing element 26 is again moved towards the raised position, in such a way as to disengage the second seat S2 which is moved, by the rotation of the second rotary element 10, towards the transfer substation ST2, so as to receive a new dose 33 of product.

Preferably, the second rotary element 10, during all the steps described above, is also driven substantially continuously.

Alternatively, both the first rotary element 9 and the second rotary element 10 may be operated in a step-like fashion. In the embodiment wherein the first rotary element 9 and the second rotary element 10 are driven in a step-like fashion, the step of transferring the dose 33 from the first seat S1 to the second seat S2 is performed with the first rotary element 9 and the second rotary element 10 stationary.

After the release in the rigid, cup-shaped container 2, the dose 33 inside the rigid cup-shaped container is moved, by the movement of the transport line 4, towards successive stations, comprising for example, the closing station SC (not described in detail).

It should be noted that the filling unit 1 according to this invention is particularly simple in terms of construction and at the same time is extremely flexible, and can easily adapt to different types of products and capsules.

Described below is a further embodiment of the filling unit 1, as illustrated in FIG. 18.

It should be noted that the filling unit 1 differs from those described above in terms of the following aspects and which concern the release device 6.

According to this embodiment, the release device 6 comprises one or more, for example a pair of, rotary elements (40*a*, 40*b*) rotating about respective axes of rotation (X4; X5) and a casing 66.

The rotary element (40*a*, 40*b*) is equipped with a shaft 67, extending along the axis of rotation (X4; X5); advantageously, the casing 66 extends along the same axis of rotation (X4; X5).

The shaft 67 be is also movable along the axis of rotation (X4; X5).

The axis of rotation (X4; X5) is positioned angularly inclined.

More specifically, the shaft 67 is movable relative to the casing 66 (defined below also as a tubular wrapping 66).

The casing 66 is fixed to the frame 29 of the machine 100 and forms an internal chamber for containing the product to be fed to the seats S1. The casing 66 can form the hopper 38, or it may be connected to the latter.

It should be noted that the shaft 67 of the rotary element (40*a*, 40*b*) is housed inside the casing 66, at the product containment chamber.

The rotary element (40*a*, 40*b*), in particular the shaft 67, is connected movably to the casing 66, that is, to the tubular wrapping 66 (or, equally, to the frame 29), for moving (relative to the casing 66) along the axis of rotation (X4; X5).

Preferably, the drive unit 61 of the rotary element (40*a*, 40*b*) is also movable (relative to the casing 66) along the axis of rotation (X4; X5) of the rotary element (40*a*, 40*b*), as one with the shaft 67 of the rotary element (40*a*, 40*b*).

For this reason, the drive unit 61 and the shaft 67 are movable as one along the axis of rotation (X4; X5) relative to the casing 66.

It should be noted that the filling device 6 also comprises, according to this aspect, elastic means 60, operatively connected to the casing 66 and to the rotary element (40*a*, 40*b*).

Therefore, it should be noted that the elastic means 60 are operatively interposed between the rotary element (40*a*, 40*b*) on one side and the casing 66 on the other, so as to apply a return force on the rotary element (40*a*, 40*b*).

It should also be noted that the elastic means 60 are configured to apply a return force on the rotary element (40*a*, 40*b*), directed mainly along the axis of rotation (X4; X5) towards the first end E1.

More specifically, as shown, the elastic means 60 are compressed following a movement of the first end E1 of the rotary element (40*a*, 40*b*) away from the outfeed 19 of the hopper 38 (shift upwards).

For this reason, the deformation (in particular the compression) of the elastic means 60 as a result of movement of the rotary element (40*a*, 40*b*) away from the outfeed 19 of the hopper 38 (shift upwards) generates a return force on the rotary element (40*a*, 40*b*), directed along the axis of rotation (X4; X5) towards the outfeed 19 of the hopper 38.

More specifically, the return force applies a pushing action on the rotary element (40*a*, 40*b*) directed towards the outfeed 19 of the hopper 38.

Preferably, the elastic means 60 comprise one or more springs (60A, 60B), interposed between the casing 66 and the rotary element (40*a*, 40*b*).

More specifically, the spring(s) allow the shaft 67 of the rotary element (40*a*, 40*b*) to be connected to the casing 66.

Still more specifically, the spring(s) allow the shaft 67 and the drive unit 61 of the rotary element (40*a*, 40*b*) to be connected to the casing 66.

As is shown in FIG. 18, the shaft 67 and the drive unit 61 of the rotary element (40*a*, 40*b*) are integral with each other and during their movement in an axial direction deform (compress) the springs (60A, 60B).

More specifically, the rotary element (40*a*, 40*b*) comprises a plate 62 fixed to the drive unit 61, which is directly active on the springs (60A, 60B) and during the movement of the shaft 67—drive unit 61 deforms (compresses) the springs (60A, 60B) in the direction of the axis of rotation (X4; X5) of the rotary element (40*a*, 40*b*).

In the embodiment illustrated, each spring (60A, 60B) is positioned on the outside of a screw (63A, 63B) which is fixed to the casing 66.

Preferably, each spring (60A, 60B) is mounted on the screw (63A, 63B) so as to abut the head of the screw (63A, 63B) at one end and the plate 62 at the other end.

It should be noted that, advantageously, the aspect described above makes it possible to render uniform the filling of the first seats S1.

It has been found that, in effect, in the absence of the elastic means 60 and the possibility of moving the rotary element (40*a*, 40*b*) along the axis of rotation (X4; X5), the tip (first end E1) of the helical element forming part of the rotary element (40*a*, 40*b*) is subjected to variable pressures, in particular when operated at a constant rotationally speed, due to a non-uniformity in the density of the product between the different seats E1.

The fact of allowing the movement of the rotary element (40*a*, 40*b*) longitudinally, and of applying a return force towards a position of equilibrium, allows the creation of a flow of product with a constant pressure at the outfeed from the casing 66, or equally, from the hopper 38.

More specifically, it should be noted that if the pressure on the first end E1 of the helical element of the rotary element (40*a*, 40*b*) is greater than a predetermined value (for example, on account of a product blockage close to the outfeed), the rotary element (40*a*, 40*b*) moves longitudinally along the axis of rotation (X4; X5) and, consequently, the pressure applied by the rotary element (40*a*, 40*b*) towards the outfeed 19 of the hopper 38 is reduced.

In this way, advantageously, the pressure applied by the rotary element (or rotary elements) (40*a*, 40*b*) on the product at the outfeed from the hopper 38 is substantially rendered uniform.

The final technical effect is therefore that of filling the first seats S1 with the same quantity of product, that is to say, reducing the variability regarding the quantity of product inserted inside the various seats S1.

Also defined is a device for releasing product for infusion or extraction beverages, comprising:

- a hopper 38 configured to form a chamber for containing product for infusion or extraction beverages having a casing 66 (or tubular wrapping 66),
- an element (40*a*, 40*b*) which rotates about an axis of rotation (X4; X5) positioned inside the casing 66 and designed to be movable along the axis of rotation (X4; X5);
- elastic means 60, operating on the rotary element (40*a*, 40*b*) to apply a return force on the rotary element (40*a*, 40*b*), directed mainly along the axis of rotation (X4; X5), to return the rotary element to a predetermined position of equilibrium.

According to the invention, a method is also defined for filling containing elements of single-use capsules for extraction or infusion beverages. As stated above, the term "containing elements" is deemed to mean both rigid, cup-shaped containers 2, of the type shown, and elements for filtration or retention of a dose of product connected to a rigid container.

The method according to the invention comprises the following steps:

- moving a succession of containing elements (for example, rigid, cup-shaped containers 2) along a first movement path P;
- rotating about a respective axis of rotation X4 at least one first rotating element 40*a* to create a feeding flow of product which intercepts a first containing seat S1 to be filled;
- releasing a predetermined dose 33 of product in the first containing seat S1 movable along a second movement path P1 in a region R1 for forming the dose 33;
- moving the first containing seat S1 from the region R1 for forming the dose 33 to a transfer region R2;
- transferring at the transfer region R2 the dose 33 of product from the first containing seat S1 to a second containing seat S2;
- moving the second containing seat S2 from the transfer region R2 to a release region R3 along a third movement path P2;
- transferring, at the release region R3, the dose 33 of product from the second containing seat S2 to a containing element 2 (for example, a rigid, cup-shaped container 2) advancing along the first movement path P.

According to the method, the step of moving a succession of containing elements along a first movement path P preferably comprises moving the containing elements along a first path P which is a closed loop lying on a horizontal plane.

Preferably, the succession of containing elements are moved with continuous motion.

Moreover, the step of moving the first containing seat S1 of the product towards the transfer region R2 comprises a rotation of the first seat S1 about a first vertical axis X1.

According to another aspect, the step of moving the second containing seat S2 of the product from the transfer region R2 to the release region R3 comprises a rotation of the second seat S2 about a second vertical axis X2.

According to yet another aspect, in the step of transferring the dose 33 of product from the first seat S1 to the second seat S2, the second seat S2 and the first seat S1 are superposed (positioned at different heights).

Preferably, in the step of transferring the dose 33 of product from the first seat S1 to the second seat S2, the second seat S2 is positioned above the first seat S1.

Preferably, the step of transferring the dose of beverage from the first seat S1 to the second seat S2 comprises a step of pushing (preferably using a piston 13) the dose 33 from the first seat S1 to the second seat S2.

Preferably, the pushing step comprises pushing the dose 33 from the bottom upwards.

According to another aspect, during the step of moving the first seat S1 from forming region R1 to the transfer region R2, the method comprises a step of compacting the dose 33 inside the first seat S1.

Preferably, the compacting step comprises pushing (preferably using a piston 13) the dose 33 against a compacting element 28 preferably comprising a fixed compacting disk 23, which is rotatable in an idle fashion or rotatable in a motorised fashion about a vertical axis.

According to another aspect of the invention, the method comprises rotating about a respective further axis of rotation X5 a further second rotating element 40*a* to create a recycle flow of product from an exit zone of the region R1 for forming the dose 33 to an internal zone of the same region R1 for forming the dose 33, where the first rotating element 40*a* is positioned.

The method described above is particularly simple and allows the creation of a dose 33 of product and the filling in a fast and reliable manner of a containing element, such as a rigid, cup-shaped container 2, of a single-use capsule 3 for extraction or infusion beverages with the dose 33 of product.

The invention claimed is:

1. A filling unit for filling containing elements (2) of single-use capsules (3) with a dose (33) of product for extraction or infusion beverages, comprising:

a line (4) for transporting the containing elements (2) extending along a first movement path (P) and provided with a plurality of supporting seats (5) for the containing elements (2) arranged in succession along the first movement path (P);

a station (SR) for filling the above-mentioned containing elements (2) with a dose (33) of product;

characterised in that the filling station (SR) comprises:

at least one first containing seat (S1) designed to receive a dose (33) of product and movable along a second movement path (P1);

a substation (ST1) for forming the dose (33) within the at least one first containing seat (S1) arranged at a region (R1) for forming the dose and provided with a release device (6) for releasing within the at least one first containing seat (51) a predetermined quantity of product which defines the dose (33), the release device (6) comprising a hopper (38) and at least one first rotating element (40a) configured for rotating about a respective axis of rotation (X4) stationary with respect to the hopper (38), to create a feeding flow of product that intercepts the at least one first containing seat (S1) and to release the product within the at least one first containing seat (S1);

at least one second containing seat (S2) designed to receive the dose (33) of product from the at least one first containing seat (51) and movable along a third movement path (P2);

a substation (ST2) for transferring the dose (33) of product from the at least one first containing seat (S1) to the at least one second containing seat (S2);

devices (7) for moving the at least one first containing seat (S1) between the forming substation (ST1) and the transfer substation (ST2) and between the transfer substation (ST2) and the forming substation (ST1);

a substation (ST3) for releasing the dose (33) of product from the at least one second containing seat (S2) to a containing element (2) transported by the transport line (4);

further moving devices (8) for moving the at least one second containing seat (S2) between the transfer substation (ST2) and the release substation (ST3) and between the release substation (ST3) and the transfer substation (ST2);

wherein the further devices (8) for moving the at least one second containing seat (S2) comprise a second rotary element (10) rotating about a second axis (X2) of rotation which is substantially vertical, on which is connected the at least one second containing seat (S2) to be rotated about the second axis (X2) of rotation, and wherein the second containing seats (S2) are connected to the second rotary element (10) so as to be movable at least radially relative to the second rotary element (10).

2. The filling unit according to claim 1, wherein the at least one first rotating element (40*a*) comprises an element (41*a*) having a helicoidal profile with a first end and a second end, the feeding flow of product going from the second to the first end, and the product being released inside the at least one first containing seat (S1) at the first end.

3. The filling unit according to claim 2, wherein the first end of the element (41*a*) having a helicoidal profile is arranged at an entry zone of the dose forming region (R1).

4. The filling unit according to claim 1, wherein the axis of rotation (X4) of the at least one first rotating element (40*a*) is horizontal.

5. The filling unit according to claim 1, wherein the release device (6) further comprises a second rotating element (40*b*) configured for rotating about a respective further axis of rotation (X5) stationary with respect to the hopper (38), to create a recycle flow of product.

6. The filling unit according to claim 5, wherein the second rotating element (40*b*) is provided with a respective element (41*b*) having a helicoidal profile with a first end and a second end, configured for pushing the product, along a direction defined by the further axis of rotation (X5), from an exit zone of the dose forming region (R1), at which the first end is positioned at an internal zone of the same dose forming region (R1).

7. The filling unit according to claim 5, wherein the second rotating element (40*b*) is positioned above the first rotating element (40*a*).

8. The filling unit according to claim 5, wherein the axis of rotation (X4) of the first rotating element (40*a*) and the further axis of rotation (X5) of the second rotating element (40*b*) are horizontal.

9. The filling unit according to claim 1, wherein the first movement path (P) is a closed path lying on a horizontal plane.

10. The filling unit according to claim 1, wherein the devices (7) for moving the at least one first containing seat (S1) comprise a first element (9) rotating about a first axis (X1) of rotation which is substantially vertical, on which is connected the at least one first containing seat (S1) to be rotated about the first axis (X1) of rotation.

11. The filling unit according to claim 1, further comprising at least one pushing element (26), which is movable for pushing, from the top downwards, the dose (33) from the at least one second containing seat (S2) to a corresponding containing element (2) at the release substation (ST3) of the dose.

12. The filling unit according to claim 1, wherein the release device (6) comprises at least one rotating element (40*a*, 40*b*) and a casing (66) which defines a chamber for containing the product, the at least one rotating element (40*a*, 40*b*) comprising a shaft (67) housed inside the casing (66) and configured to rotate about a respective axis of rotation (X4; X5) and movable along the respective axis of rotation (X4; X5) relative to the casing (66).

13. The filling unit according to claim 12, further comprising elastic means (60) acting on the rotating element (40*a*; 40*b*) and on the casing (66) and configured for applying a return force on the rotating element (40*a*; 40*b*), directed mainly along the respective axis of rotation (X4; X5), as a result of a movement of the rotating element (40*a*; 40*b*) relative to the casing (66).

14. A packaging machine (100) designed to package single-use capsules (3) for extraction or infusion beverages comprising a filling unit (1) according to claim 1; a station (SA) for feeding containing elements (2) of the single-use capsules (3) in corresponding supporting seats (5) of a transport line (4) of the filling unit (1); a station (SC) for closing the containing element (2) with a lid (34); and an outfeed station (SU) which picks up the capsules (3) from the supporting seats (5) of the transport line (4).

15. A filling unit for filling containing elements (2) of single-use capsules (3) with a dose (33) of product for extraction or infusion beverages, comprising:

a line (4) for transporting the containing elements (2) extending along a first movement path (P) and provided with a plurality of supporting seats (5) for the containing elements (2) arranged in succession along the first movement path (P);

a station (SR) for filling the above-mentioned containing elements (2) with a dose (33) of product;

characterised in that the filling station (SR) comprises:

at least one first containing seat (S1) designed to receive a dose (33) of product and movable along a second movement path (P1);

a substation (ST1) for forming the dose (33) within the at least one first containing seat (S1) arranged at a region (R1) for forming the dose and provided with a release device (6) for releasing within the at least one first containing seat (S1) a predetermined quantity of product which defines the dose (33), the release device (6) comprising a hopper (38) and at least one first rotating element (40*a*) configured for rotating about a respective axis of rotation (X4) stationary with respect to the hopper (38), to create a feeding flow of product that intercepts the at least one first containing seat (S1) and to release the product within the at least one first containing seat (S1);

at least one second containing seat (S2) designed to receive the dose (33) of product from the at least one first containing seat (S1) and movable along a third movement path (P2);

a substation (ST2) for transferring the dose (33) of product from the at least one first containing seat (S1) to the at least one second containing seat (S2);

devices (7) for moving the at least one first containing seat (S1) between the forming substation (ST1) and the transfer substation (ST2) and between the transfer substation (ST2) and the forming substation (ST1);

a substation (ST3) for releasing the dose (33) of product from the at least one second containing seat (S2) to a containing element (2) transported by the transport line (4);

further moving devices (8) for moving the at least one second containing seat (S2) between the transfer substation (ST2) and the release substation (ST3) and between the release substation (ST3) and the transfer substation (ST2);

wherein the at least one first containing seat (51) is defined by lateral walls of a cavity (18) and by a bottom wall (F), the filling unit comprising, for each first containing seat (S1):

a piston (13) movable between a lower position where it defines the bottom wall (F) of the at least one first containing seat (S1) and an upper position where it closes the top of the cavity (18);

means (14) for moving the piston (13), for moving the piston (13) between the lower and upper positions.

16. The filling unit according to claim 15, wherein the moving means (14) for moving the piston (13) are designed to move the piston (13) from the upper position to the lower position at an entry zone of the dose forming region (R1), and to position the piston (13) in a dosing position, arranged between the lower position and the upper position, at an exit zone of the dose forming region (R1), to define the dose (33) in cooperation with a scraper element (22) of the release device (6).

17. The filling unit according to claim 15, comprising a checking and control unit (15), connected to the means (14) for moving the piston (13) and configured for moving the piston (13) to the upper position at the dose transfer substation (ST2), so as to transfer the dose (33) from the at least one first containing seat (S1) to the at least one second containing seat (S2).

* * * * *